US006666746B2

(12) United States Patent
Aldred et al.

(10) Patent No.: US 6,666,746 B2
(45) **Date of Patent: *Dec. 23, 2003**

(54) CONTROL SYSTEM FOR, AND METHOD OF, OPERATING TOY VEHICLES

(75) Inventors: Daniel J. Aldred, Encinitas, CA (US); William H. Barton, Jr., Encinitas, CA (US); Peter C. DeAngelis, Carlsbad, CA (US); Paul Eichen, Oxnard, CA (US)

(73) Assignee: Rokenbok Toy Company, Encinitas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/155,186

(22) Filed: May 23, 2002

(65) Prior Publication Data

US 2003/0013377 A1 Jan. 16, 2003

Related U.S. Application Data

(62) Division of application No. 09/487,010, filed on Jan. 19, 2000, now Pat. No. 6,450,856.

(51) Int. Cl.[7] ..... A63H 30/00

(52) U.S. Cl. ..... 446/454; 446/431; 446/454; 446/456; 446/441; 446/444; 446/457; 446/460; 446/465; 446/470; 446/120; 446/268; 446/425; 463/3; 463/38; 463/39; 463/40; 463/58; 463/62; 463/63

(58) Field of Search ..... 463/3, 38–39, 463/40, 58, 62, 63; 446/431, 454, 456, 441, 444, 457, 460, 465, 470, 120, 268, 425

(56) References Cited

U.S. PATENT DOCUMENTS

| | | | | |
|---|---|---|---|---|
| 3,722,135 A | * | 3/1973 | Jacobson | 446/425 |
| 4,334,221 A | * | 6/1982 | Rosenhagen et al. | 463/6 |
| 5,098,110 A | * | 3/1992 | Yang | 463/39 |
| 6,450,856 B1 | * | 9/2002 | Aldred et al. | 446/454 |

* cited by examiner

*Primary Examiner*—Kim Nguyen
(74) *Attorney, Agent, or Firm*—Fulwider Patton, et al.; Ellsworth R. Roston

(57) ABSTRACT

Each of first vehicles has an individual address dependent upon an insertion of a selective one of different keys into a socket in the vehicle. Each vehicle is movable in any desired direction on a first support structure formed by intercoupling male detents on first beams and female detents on other beams and on blocks. The first support structure may be, but does not have to be, intercoupled with a second support structure. The second structure may define a track on which an additional vehicle (e.g., a monorail) is movable in first and second opposite directions. Each of a plurality of manually operated pads generates signals for addressing any unaddressed vehicle and for providing movements of, and the performance of functions in, the vehicle when addressed. Each pad communicates the pad-generated signals to a connected central station. The central station communicates these signals by wireless to the vehicles.

34 Claims, 26 Drawing Sheets

VCC
POWER UP RESET
122
VCC
130
12
TIME BASE FOR MICROCONTROLLER
XTAL
MICRO CONTROLLER
RAM
ROM
126
124
VEHICLE ADDRESS SELECT
128
130
132
MOTOR 1
28
TRANSISTOR DRIVER
4
120
MOTOR 2
30
TRANSISTOR DRIVER
4
120
MOTOR 3
32
TRANSISTOR DRIVER
4
120
MOTOR 4
33
TRANSISTOR DRIVER
4
120
POWER ON
69
RF POWER MANAGEMENT
RF RECEIVER
121
BATTERY
VCC
4.5V
GND

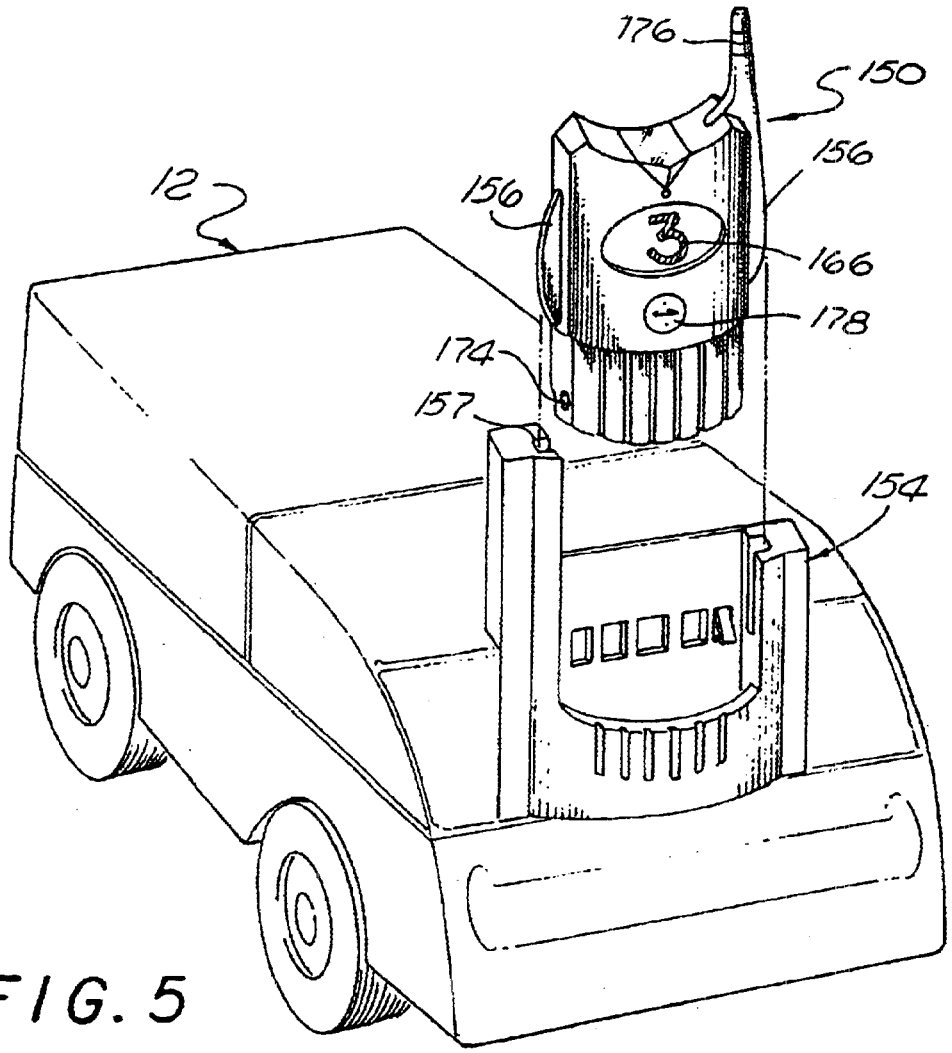
FIG. 5
FIG. 6
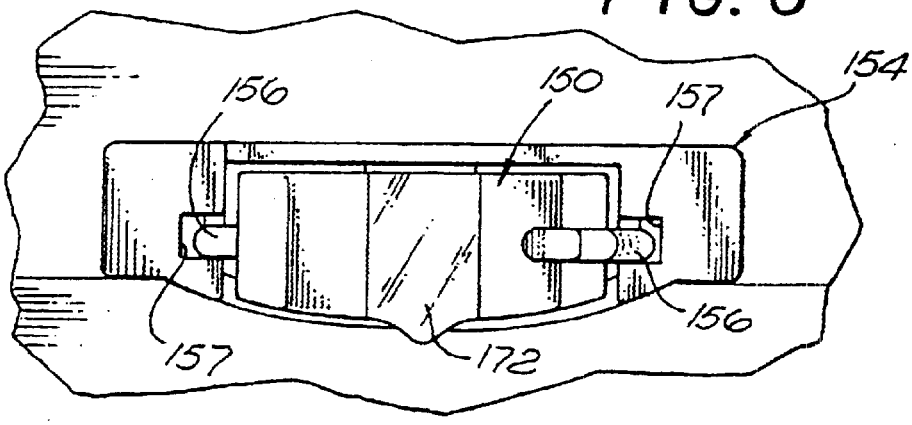

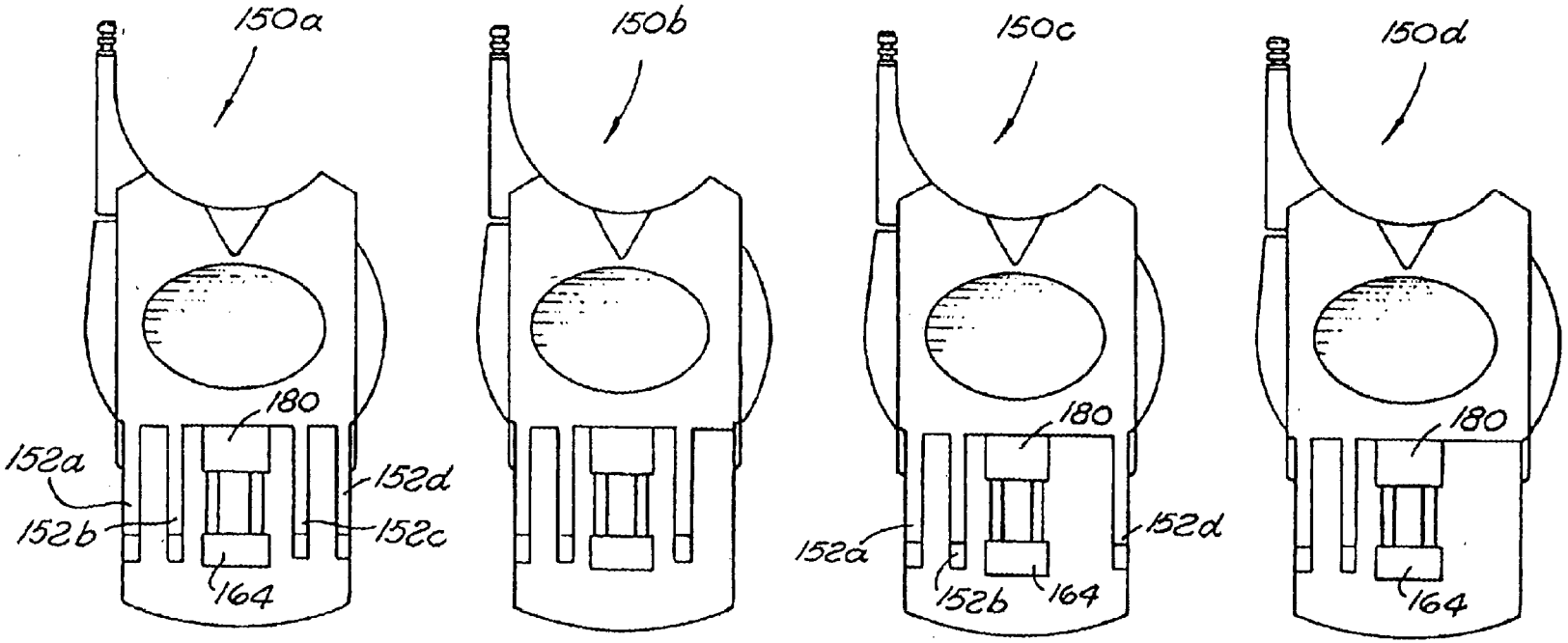
FIG. 9a
FIG. 9b
FIG. 9c
FIG. 9d
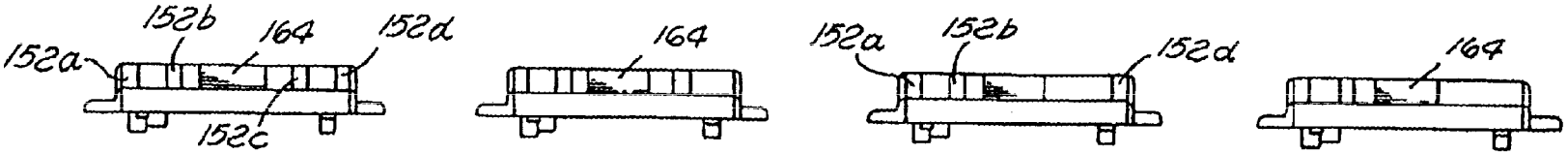
FIG. 10a
FIG. 10b
FIG. 10c
FIG. 10d FIG. 18
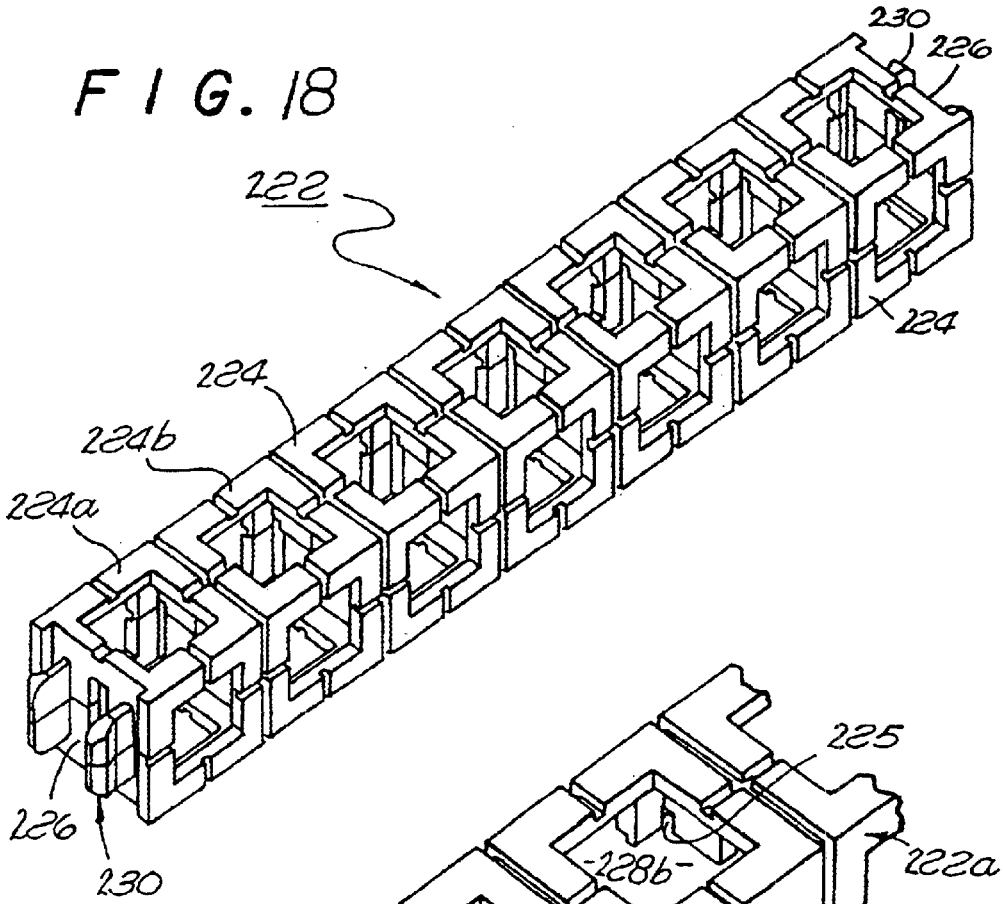
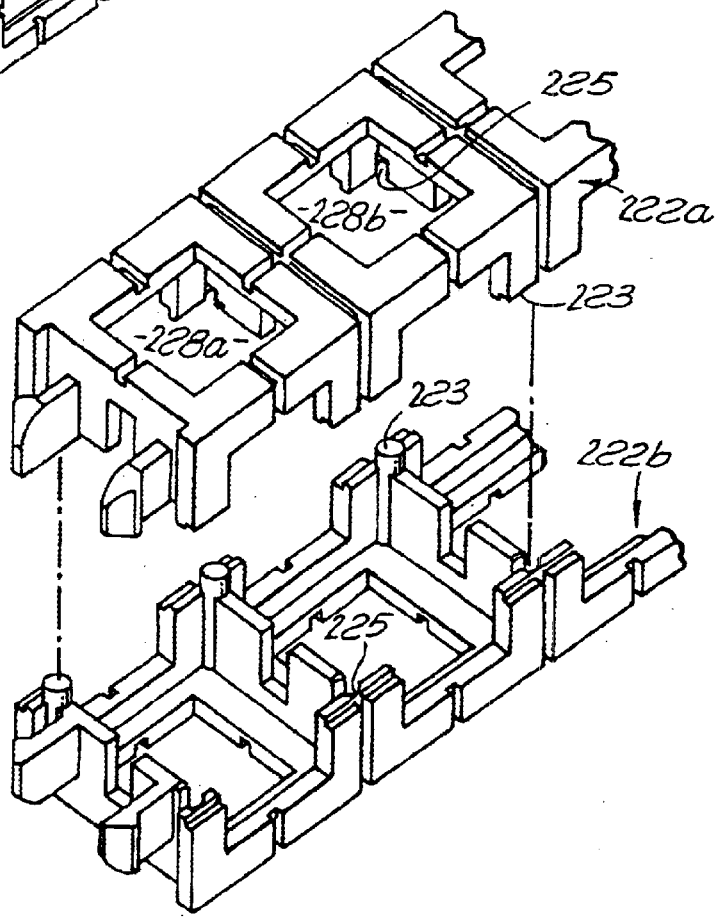
FIG. 19

CONTROL SYSTEM FOR, AND METHOD OF, OPERATING TOY VEHICLES

This application is a division of application Ser. No. 09/487,010 filed Jan. 19, 2000 (now U.S. Pat. 6,450,856 B1.)

This invention relates to a system for pleasurable use by people of all ages with youthful minds in operating remotely controlled vehicles simultaneously in a somewhat confined area. In the system of this invention, the vehicles can be remotely controlled to perform competitive or cooperative tasks. The system of this invention includes pads for operation by the users, vehicles remotely controlled in accordance with the operation of the pads and a central station for coordinating the operation of the pads and the vehicles. The invention additionally relates to methods of controlling the operation of the vehicles on a remotely controlled basis.

The system and method of this invention include first and second intercoupled support structures which may, but do not have to be, intercoupled. The first support structure provides for the movement of first vehicles in any direction on the support structure. The second support structure provides a track for a movement of an additional vehicle on the track. The additional vehicle may be a monorail. The first and second support structures are formed from coupling members (e.g. beams), all of the same construction, intercoupled to one another and to blocks, all of the same construction.

BACKGROUND OF THE PREFERRED EMBODIMENT

Various types of play systems exist, and have existed for some time, in which vehicles are moved on a remotely controlled basis. However, such systems generally provide one hand-held unit and one remotely controlled vehicle for operation by the hand-held unit. Examples of a vehicle in such a system are a toy automobile or a toy airplane. Furthermore, the functions of the remotely controlled unit, other than movement along a floor or along the ground or in the air, are quite limited.

Other types of play systems involve the use of blocks for building structures. These blocks often include detents for providing an interlocking relationship between abutting blocks. In this way, elaborate structures can be created by users with creative minds. These systems do not involve the use of a plurality of vehicles, each of which is individually addressed and each of which is controlled on a remote basis.

Tests have indicated that there is a desirability, and even a need, for play systems in which vehicles are remotely operated to perform functions other than to move aimlessly along a floor or along the ground. For example, tests have indicated that there is a desirability, and even a need, for play systems in which the remotely controlled vehicles can transport elements such as blocks to construct creative structures. There is also a desirability, and even a need, for play systems in which a plurality of vehicles can be remotely controlled by switches in hand-held pads to compete against one another in performing a first task or to cooperate in performing a second task. Such a desirability, or even a need, has existed for a long period of time, probably decades, without a satisfactory resolution.

U.S. Pat. No. 5,944,607 issued to John J. Crane on Aug. 31, 1999, for a "Remote Control System for Operating Toys" and assigned of record to the assignee of record of this application discloses and claims a play system for use by people of all ages with youthful minds. It provides for a simultaneous control by each player of an individual one of a plurality of remotely controlled vehicles. This control is provided by the operation by each player of switches in a hand-held unit or pad. The operation of each switch in such hand-held unit provide for an addressing of an individual one of the remotely controlled vehicles and for a control of a different function in the vehicle. Each of the remotely controlled vehicles in the system disclosed and claimed in U.S. Pat. No. 5,944,607 can be operated in a competitive relationship with others of the remotely controlled vehicles or in a cooperative relationship with others of the remotely controlled vehicles. The vehicles can be constructed to pick up and transport elements such as blocks or marbles and to deposit such elements at displaced positions.

When manually closed in one embodiment of the system disclosed and claimed in U.S. Pat. No. 5,944,607, switches in pads control the selection of toy vehicles and the operation of motors for moving the selected vehicles forwardly, rearwardly, to the left and to the right and control the movement moving upwardly and downwardly (and rightwardly and leftwardly) of a receptacle for holding transportable elements (e.g. marbles or blocks).

When interrogated by a central station, each pad in the system disclosed and claimed in U.S. Pat. No. 5,944,607 sends through wires to the central station signals indicating the switch closures in such pad. Such station produces first binary signals addressing the vehicle selected by such pad and second binary signals identifying the motor control operations in such vehicle. Thereafter the switches identifying in such pad the motor control operations in such selected vehicle can be closed without closing the switches addressing such vehicle. The central station then identifies the vehicle on the basis of the command signals from the pad even though the pad does not identify the vehicle. The central station identifies the vehicle in this manner because the central station stores the relationship between the pad and the vehicle.

The first and second signals for each vehicle in the system disclosed and claimed in U.S. Pat. No. 5,944,607 are transmitted by wireless by the central station to all of the vehicles at a common carrier frequency modulated by the first and second binary signals. The vehicle identified by the transmitted address demodulates the modulating signals and operates its motors in accordance with such demodulation. When the vehicle fails to receive signals from a pad for a particular period of time, the vehicle previously selected by such pad becomes available for selection by that pad or any other pad and that pad can select that vehicle or another vehicle.

In the preferred embodiment disclosed and claimed in U.S. Pat. No. 5,888,135 issued on Mar. 30, 1999, and assigned of record to the assignee of record of this application, a key in a vehicle socket closes contacts to reset a microcontroller in the vehicle to a neutral state. Ribs disposed in a particular pattern in the key operate switches in a particular pattern in the vehicle to provide an address for the vehicle and to dispose the vehicle in an inactive but powered state.

As disclosed and claimed in U.S. Pat. No. 5,888,135, when the vehicle receives such individual address from an individual one of the pads, the vehicle is operated by commands transmitted by the pad to the vehicle within a first particular time thereafter. Such individual pad operates such vehicle as long as such vehicle receives commands from such individual pad within the first particular period after the previous command from such individual pad. During this period, the vehicle has a first illumination to indicate that it is being operated in an active and powered state.

When the individual pad in U.S. Pat. No. 5,888,135 fails to provide commands to such vehicle within such first particular time period, the vehicle becomes inactive but powered and provides a second illumination. While inactive but powered, the vehicle can be addressed and subsequently commanded by any pad including the individual pad and the addressing pad thereafter commands the vehicle. The vehicle becomes deactivated and not illuminated if (a) the vehicle is not selected by any of the pads during a second particular time period after becoming inactivated but powered or, alternatively, (b) all of the vehicles become inactivated but powered and none is selected during the second particular period. The key can thereafter be actuated to operate the vehicle to the inactive but powered state.

U.S. Pat. No. 5,826,394 issued on Oct. 27, 1998, and assigned of record to the assignee of record of this application discloses and claims preferred embodiments of coupling members (e.g. beams) which can be intercoupled or can be coupled to blocks to form support structure on which the vehicles can be transported in any desired direction. Each of the beams has the same male detents, and the same female detents, as the other beams. The blocks have only the female detents. The male detent on each beam intercouples with a female detent on any other coupling beam, or intercouples with one of the female detents on one of the blocks, to form the support structure. This support structure can be of any complex configuration involving some creativity. The support structure can have any desired configuration. Furthermore, the female detents on a single block can operate in conjunction with a number of beams to extend the support structure in as many as six (6) different directions. The male and female detents can be easily coupled to one another and can be easily separated from one another. However, when the beams are intercoupled or the beams and blocks are intercoupled, a strong and effective relationship exists between them.

An opening is provided in at least a particular one of the faces, and preferably in the four (4) faces defining a closed loop, in the beam disclosed and claimed in U.S. Pat. No. 5,826,394. These openings define the female detents. Substantially parallel snaps extend from the other two (2) beam walls and have at their outer ends portions shaped to facilitate (a) insertion of such snaps into the opening in the particular face of the block or into the opening in a face of another beam, (b) retention of the snaps by the inner surface of the face defining the opening and (c) removal of the snaps from the opening. Such portions are shaped for the snaps on the beams to be pulled, peeled or bent from the faces in the blocks. When the beams become decoupled from the blocks the snaps may be considered as the male detents.

When the block disclosed and claimed in U.S. Pat. No. 5,826,394 has an opening in each of its six (6) faces, snaps from six (6) different beams can extend into the six (6) different openings in six (6) different directions in the block without any interference in the block between the snaps in the six (6) beams. In this way, complex structures can be formed from the blocks and the beams. Other structures such as vehicle ramps, building roofs, awnings and corbels can be disposed in cooperative relationship with structure formed from the blocks and the beams and can be intercoupled into the supporting structure by male and female detents in the vehicle ramps, building roofs, awnings and corbel.

Since the block and the beams disclosed and claimed in U.S. Pat. No. 5,826,394 have the shapes of rectangular prisms, they have a uniform disposition on a support surface such as a floor or a table. Furthermore, since such block preferably has six (6) faces all of substantially identical construction and all defining female detents, children can easily assembly the snaps at either of the opposite ends of the beam into the opening in any one of the faces in the block without affecting the relationship between the block and the beam when other beams are attached to other faces of the block.

The blocks and the beams disclosed and claimed in U.S. Pat. No. 5,826,394 also have other advantages. Only blocks and beams are required to construct complex structures. This is in contrast to the prior art where a number of different types of members are required to construct complex structures. Furthermore, the openings in the blocks in the system of this invention constitute female members. This provides for a universality in the use of the blocks. When the blocks have openings in all six (6) of their faces, any of the faces can be coupled to one of the beams. This enhances the universality in the usage of the system in constructing creative structures of some complexity.

The blocks and beams have been disclosed in U.S. Pat. No. 5,826,394 as being preferably rectangular. However, the beams can be curved in any desired shape as a practical manner without departing from the scope of the preferred embodiment disclosed in U.S. Pat. No. 5,826,394. Even when curved, the beam can be intercoupled with a block and with other beams in the same manner as described above.

BRIEF DESCRIPTION OF THE INVENTION

The preferred embodiment of this invention utilizes features disclosed and claimed in U.S. Pat. No. 5,944,607, U.S. Pat. No. 5,888,135 and U.S. Pat. No. 5,826,394, all assigned of record to the assignee of record of this application. The preferred embodiments of this invention combine these features with features individual to the preferred embodiments of this invention to obtain a unique and patentable toy system with enhanced features. In this toy system, one of the vehicles can constitute a monorail constructed to ride on a track formed from the beams and the blocks.

In a preferred embodiment of this invention, each of first vehicles has an individual address dependent upon an insertion of a selective one of different keys into a socket in the vehicle. Each of the first vehicles is movable in any desired direction on a first support structure formed by intercoupling male detents on first beams and female detents on other beams, all of them having the same construction, and by intercoupling the male detents on the beams to female detents on blocks, all having an identical construction.

The first support structure may be, but does not have to be, intercoupled with a second support structure formed by intercoupling beams and blocks of the same type as the beams and blocks in the first structure. The second structure defines a track on which an additional vehicle addressable in the same manner as the first vehicles is movable in first and second opposite directions. The additional vehicle may constitute a monorail.

The additional vehicle has rollers for driving the vehicle (e.g., monorail) on the track and has guides (e.g., positioning rollers) disposed contiguous to the side surfaces of the track blocks for retaining the vehicle on the track during the vehicle movement on the track. Each vehicle has motor(s) for moving the vehicle on its support structure and has members for performing function(s) other than vehicular movements. The members may be controlled by motors different from the motors for moving the vehicles.

Each of a plurality of manually operated pads generates signals for addressing any unaddressed vehicle (including the first vehicles and the additional vehicle) and for providing movements of, and the performance of functions in, the vehicle when addressed. Each pad may control the operation of one of the vehicles not addressed by the other pads. Each pad communicates to a central station the signals generated by the pad. This communication is through wires connected between the pad and the central station. The central station communicates these signals by wireless to the vehicles.

BRIEF DESCRIPTION OF THE DRAWINGS

In the drawings:

FIG. 5 is an exploded perspective view of a vehicle and a key which is insertable into a socket in the vehicle to provide an individual address for the vehicle;

FIG. 6 is a top plan view of the vehicle and the key with the key inserted into the vehicle;

FIGS. 9*a*–9*h* are front elevational views of different keys each with an individual combination of ribs to provide an individual address in accordance with the individual combination of the ribs, to a vehicle in which such key is inserted;

FIGS. 10*a*–10*h* are bottom plan views respectively of the keys shown in FIGS. 9*a*–9*h* and particularly show the disposition of the ribs which provide the individual address for each of the different keys;

FIG. 18 is a perspective view of a beam which can be cooperatively coupled to the block shown in FIG. 16 to provide for the creation of complex structures when a plurality of blocks and beams are coupled to one another in original patterns;

FIG. 19 is an enlarged exploded perspective view of two (2) duplicative sections which can be combined to form the beam shown in FIG. 18;

FIG. 1) in any desired direction and of a track for movement of the monorail (FIGS. 28 and 31) and particularly shows a conveyor for loading play elements (e.g. marbles) into the monorail and an arrangement for transferring the play elements from the monorail into vehicles (e.g. FIG. 1);

DETAILED DESCRIPTION OF PREFERRED EMBODIMENTS OF THE INVENTION

Figure 1:
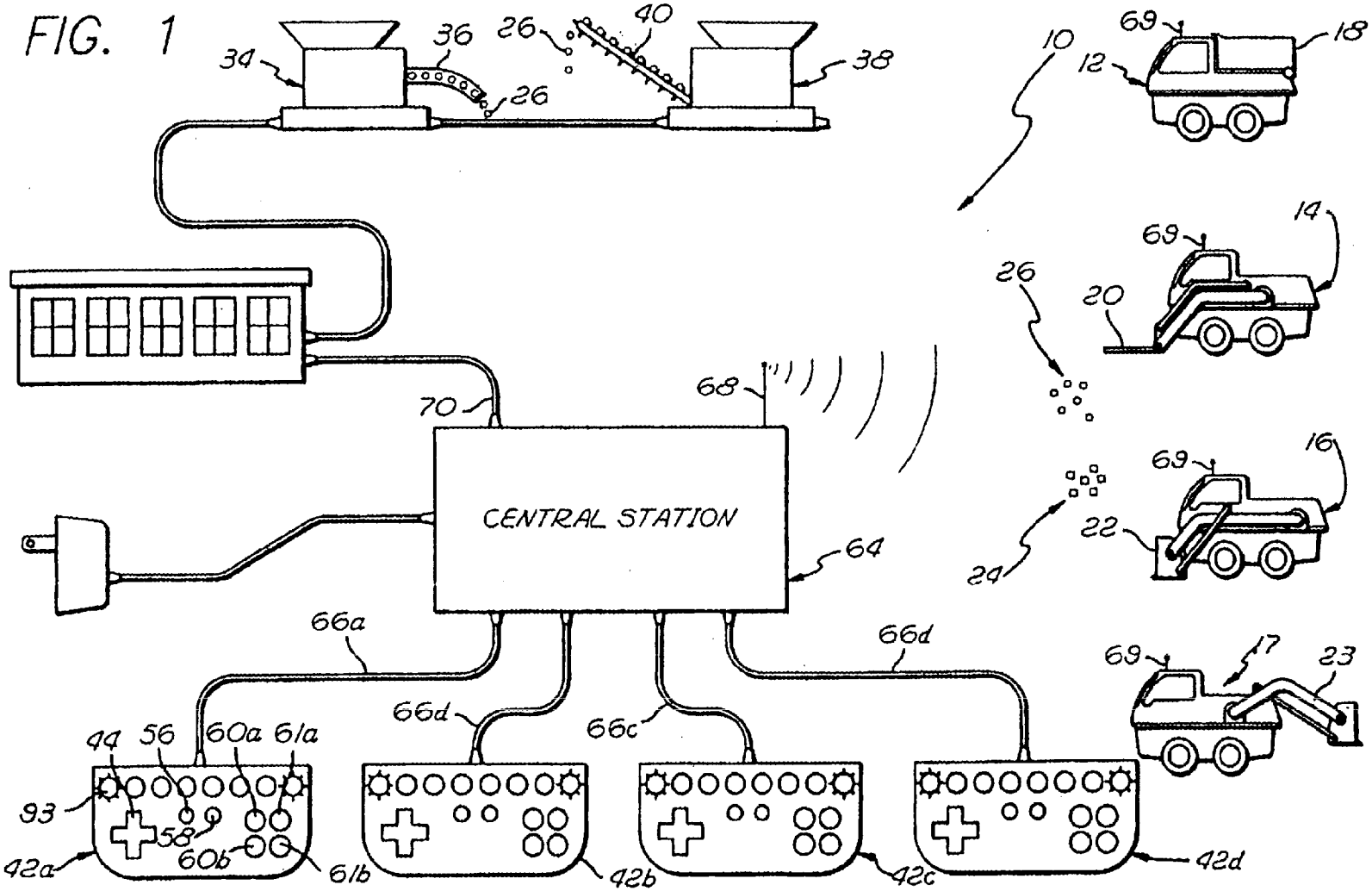
FIG. 1 is a schematic diagram, primarily in block form, of a system constituting one embodiment of the invention.

In one embodiment of the invention, a system generally indicated at 10 in FIG. 1 is provided for controlling the selection and operation of a plurality of toy vehicles. Illustrative examples of toy vehicles constitute a dump truck generally indicated at 12, a fork lift generally indicated at 14, a skip loader generally indicated at 16 and another form of skip loader generally indicated at 17. The toy vehicles such as the dump truck 12, the fork lift 14 and the skip loaders 16 and 17 are simplified versions of commercial units performing functions similar to those performed by the toy vehicles 12, 14, 16 and 17. For example, the dump truck 12 may include a working or transport member such as a pivotable bin or container 18; the fork lift 14 may include a working or transport member such as a pivotable platform 20; the skip loader 16 may include a working or transport member such as a pivotable bin or container 22 disposed at the front end of the skip loader; and the skip loader 17 may include a working or transport member such as a pivotable bin or container 23 disposed at the rear end of the skip loader. The working or transport members such as the pivotable bin or container 18, the pivotable platform 20 and the pivotable bins or containers 22 and 23 are constructed to carry storable and/or transportable elements such as blocks 24 or marbles 26 shown schematically in FIG. 1. The marbles 26 may be constructed in a manner similar to that disclosed and claimed in patent 5 issued on [date] and assigned of record to the assignee of record in this application.

Each of the dump truck 12, the fork lift 14 and the skip loaders 16 and 17 may include a plurality of motors. For example, the dump truck 12 may include a pair of reversible motors 28 and 30 (FIG. 4) operable to move the dump truck forwardly, rearwardly, to the right and to the left. The motor 28 controls the movement of the front and rear left wheels and the motor 30 controls the movement of the front and rear right wheels.

When the motors 28 and 30 are simultaneously operated in one direction, the dump truck 12 moves forwardly. The vehicle 12 moves rearwardly when the motors 28 and 30 are operated in the opposite direction. The vehicle 12 turns toward the left when the motor 30 is operated without simultaneous operation of the motor 28. The vehicle 12 turns toward the right when the motor 28 is operated without a simultaneous operation of them motor 30.

The vehicle 12 spins to the left when the motor 30 operates to move the vehicle forwardly at the same time that the motor 28 operates to move the vehicle rearwardly. The vehicle 12 spins to the right when the motors 28 and 30 are operated in directions opposite to the operations of the motors in spinning the vehicle to the left.

Another reversible motor 32 in the dump truck 12 operates in one direction to pivot the bin 18 upwardly and in the other direction to pivot the bin downwardly. An additional motor 33 may operate in one direction to turn the bin 18 to the left and in the other direction to turn the bin to the right.

The construction of the motors 28, 30, 32 and 33 and the disposition of the motors in the dump truck to operate the dump truck are considered to be well known in the art. The fork lift 14 and the skip loaders 16 and 17 may include motors corresponding to those described above for the dump truck 12.

The system 10 may also include stationary plants or accessories. For example, the system 10 may include a pumping station generally indicated at 34 (FIG. 1) for pumping elements such as the marbles 26 through a conduit 36. The system may also include a conveyor generally indicated at 38 for moving the elements such as the marbles 26 upwardly on a ramp 40. When the marbles reach the top of the ramp 40, the elements such as the marbles 26 may fall into the bin 18 in the dump truck 12 or into the bin 22 in the skip loader 16. For the purposes of this application, the construction of the pumping station 34 and the conveyor 38 may be considered to be within the purview of a person of ordinary skill in the art.

The system 10 may also include a plurality of hand-held pads generally indicated at 42*a*, 42*b*, 42*c* and 42*d* (FIG. 1). Each of the pads 42*a*, 42*b*, 42*c* and 42*d* may have a substantially identical construction. Each of the pads may include a plurality of actuatable buttons. For example, each of the pads may include a 4-way button 44 in the shape of a cross. Each of the different segments in the button 44 is connected to an individual one of a plurality of switches 46, 48, 50 and 52 in FIG. 2.

When the button 44 is depressed at the segment at the top of the button, the switch 46 is closed to obtain the operation of the motors 28 and 30 (FIG. 4) in moving the selected one of the vehicle 12 forwardly. Similarly, when the segment at the bottom of the button 44 is depressed, the switch 48 is closed to obtain the operation of the motors 28 and 30 (FIG. 4) in moving the vehicle 12 rearwardly. The selective depression of the right and left segments of the button 44 cause the motors 28 and 30 to operate in spinning the vehicle in individual ones of the two (2) opposite directions.

It will be appreciated that pairs of segments of the button 44 may be simultaneously depressed. For example, the top and left portions of the button 44 may be simultaneously depressed to obtain a simultaneous movement of the vehicle 12 forwardly and to the left. This is in accordance with the operation of a microcontroller which will be described in detail subsequently. However, a simultaneous actuation of the top and bottom segments of the button 44 will not have any effect since they represent contradictory commands. This is also true of a simultaneous depression of the left and right segments of the button 44.

Figure 2:
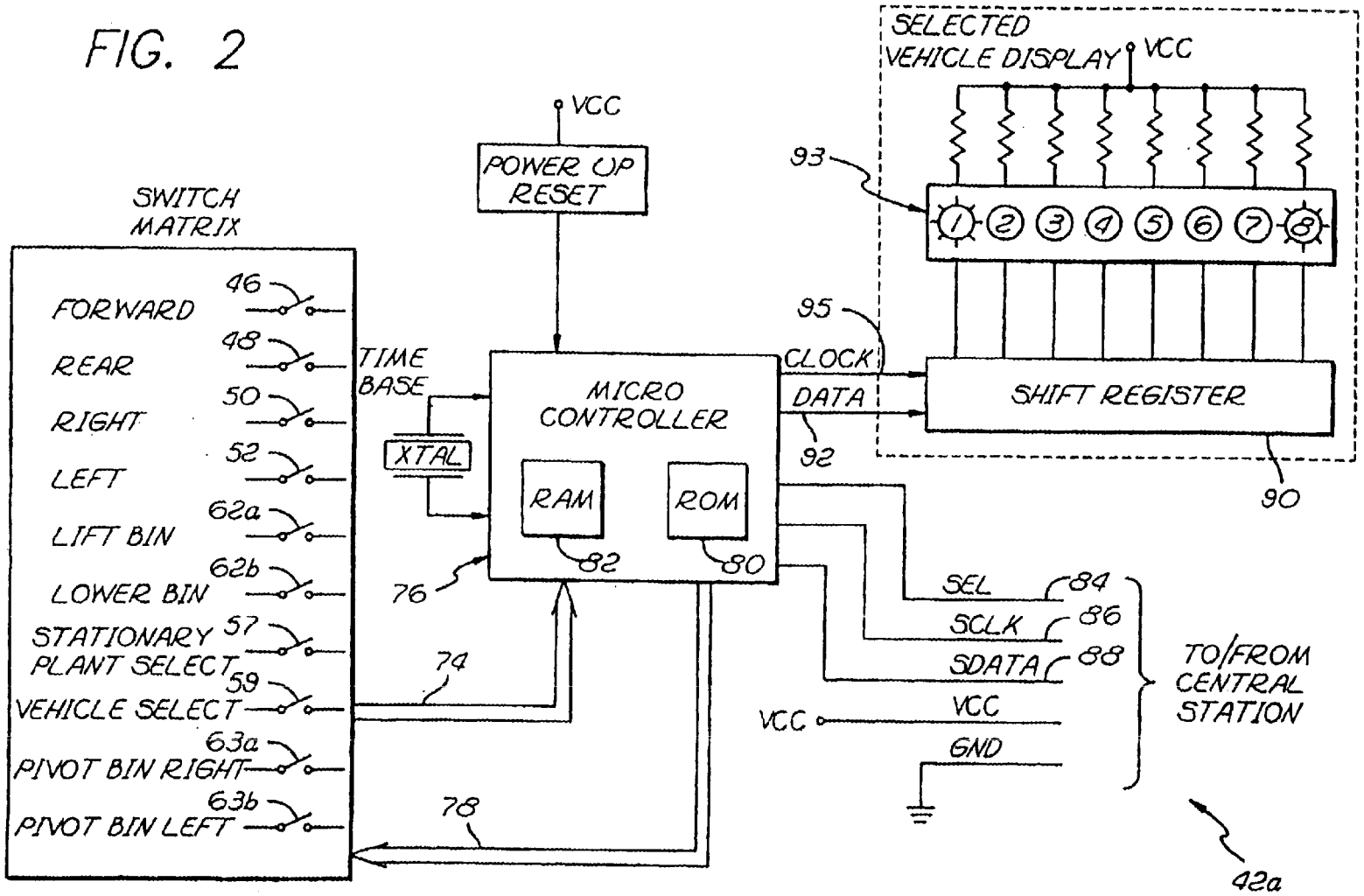
FIG. 2 is a schematic diagram, primarily in block form, of the different features in a pad included in the system shown in FIG. 1.

Each of the pads 42*a*, 42*b*, 42*c* and 42*d* may include a button 56 (FIG. 1) which is connected to a switch 57 (FIG. 2). Successive depressions of the button 56 on one of the pads within a particular period of time cause different ones of the stationary accessories or plants such as the pumping station 34 and the conveyor 38 to be energized. For example, a first depression of the button 56 in one of the pads 42*a*, 42*b*, 42*c* and 42*d* may cause the pumping station 34 to be energized and a second depression of the button 56 within the particular period of time in such pad may cause the conveyor 38 to be energized. When other stationary accessories are included in the system 10, each may be individually energized by depressing the button 56 a selective number of times within the particular period to time. When the button 56 is depressed twice within the particular period of time, the energizing of the pumping station 34 is released and the conveyor 38 is energized. This energizing of a selective one of the stationary accessories occurs at the end of the particular period of time.

A button 58 is provided in each of the pads 42*a*, 42*b*, 42*c* and 42*d* to select one of the vehicles 12, 14, 16 and 17. In the system disclosed and claimed in application Ser. No. 08/580,753, the individual one of the vehicles 12, 14, 16 and 17 selected at any instant by each of the pads 42*a*, 42*b*, 42*c* and 42*d* is dependent upon the number of times that the button 58 is depressed in that pad within a particular period of time. The system disclosed and claimed in this invention operates in a similar manner. For example, one (1) depression of the button 58 may cause the dump truck 12 to be selected and two (2) sequential selections of the button 58 within the particular period of time may cause the fork lift 14 to be selected.

Every time that the button 58 is actuated or depressed within the particular period of time, a switch 59 (in FIG. 2) is closed. The particular period of time for depressing the button 58 may have the same duration as, or a different direction than, the particular period of time for depressing the button 56. An adder is included in the pad 12 to count the number of depressions of the button 58 within the particular period of time. This count is converted into a plurality of binary signals indicating the count. The count is provided at the end of the particular period of time. The binary signals in the plurality indicate the individual one of the vehicles 12, 14, 16 and 17 to be addressed.

Buttons 60*a* and 60*b* are also included on each of the pads 42*a*, 42*b*, 42*c* and 42*d*. When depressed, the buttons 60*a* and 60*b* respectively close switches 62*a* and 62*b* in FIG. 2. The closure of the switch 62*a* is instrumental in producing an operation of the motor 32 in a direction to lift the bin 18 in the dump truck 12 when the dump truck has been selected by the proper number of depressions of the button 58 within the particular period of time. In like manner, when the dump truck 12 has been selected by the proper number of depressions of the switch 58 within the particular period of time, the closure of the switch 62*b* causes the bin 18 in the dump truck 12 to move downwardly as a result of the operation of the motor 32 in the reverse direction.

It will be appreciated that other controls may be included in each of the pads 42*a*, 42*b*, 42*c* and 42*d*. For example, buttons 61*a* and 61*b* may be included in each of the pads 42*a*, 42*b*, 42*c* and 42*d* to pivot the bin 18 to the right or left when the vehicle 12 has been selected. Such movements facilitate the ability of the bin 18 to scoop elements such as the blocks 24 and the marbles 26 upwardly from the floor or ground or from any other position and to subsequently deposit such elements on the floor or ground or any other position.

Switches 63*a* and 63*b* (FIG. 2) are respectively provided in the pad 42*a* in association with the buttons 61*a* and 61*b* and are closed by the respective actuation of the buttons 61*a* and 61*b* to move the bin or the platform in the vehicle 12 to the left or right when the vehicle has been selected. It will be appreciated that different combinations of buttons may be actuated simultaneously to produce different combinations of motions. For example, a bin in a selected one of the vehicles may be moved at the same time that the selected one of the vehicles is moved.

A central station generally indicated at 64 in FIG. 1 processes the signals from the individual ones of the pads 42*a*, 42*b*, 42*c* and 42*d* and sends the processed signals to the vehicles 12, 14, 16 and 17 when the button 58 on an individual one of the pads has been depressed to indicate that the information from the individual ones of the pads is to be sent to the vehicles. The transmission may be on a wireless basis from an antenna 68 (FIG. 10 in the central station to antennas 69 on the vehicles.

The transmission may be in packets of signals. This transmission causes the selected ones of the vehicles 12, 14, 16 and 17 to perform individual ones of the functions directed by the depression of the different buttons on the individual ones of the pads. When the commands from the individual ones of the pads 42*a*, 42*b*, 42*c* and 42*d* are to pass to the §stationary accessories 34 and 38 as a result of the depression of the buttons 56 on the individual ones of the pads, the central station processes the commands and sends signals through cables 70 to the selected ones of the stationary accessories.

FIG. 2 shows the construction of the pad 42*a* in additional detail. It will be appreciated that each of the pads 42*b*, 42*c* and 42*d* may be constructed in a substantially identical manner to that shown in FIG. 2. As shown in FIG. 2, the pad 42*a* includes the switches 46, 48, 50 and 52 and the switches 57, 59, 62*a*, 62*b*, 63*a* and 63*b*. Buses 74 are shown as directing indications from the switches 46, 48, 50, 52, 57, 59, 62*a*, 62*b*, 63*a* and 63*b* to a microcontroller generally indicated at 76 in FIG. 2. Buses 78 are shown for directing signals from the microcontroller 76 to the switches.

The microcontroller 76 is shown as including a read only memory (ROM) 80 and a random access memory (RAM) 82. Such a microcontroller may be considered to be standard in the computing industry. However, the programming in the microcontroller and the information stored in the read only memory 80 and the random access memory 82 are individual to this invention.

The read only memory 80 stores permanent information and the random access memory stores volatile (or impermanent) information. For example, the read only memory 80 may store the sequence in which the different switches in the pad 42*a* provide indications of whether or not they have been closed. The random access memory 82 may receive this sequence from the read only memory 80 and may store indications of whether or not the switches in the particular sequence have been closed for each individual one of the pads 42*a*, 42*b*, 42*c* and 42*d*.

The pad 42*a* in FIG. 2 receives the interrogating signals from the central station 64 through a line 84. These interrogating signals are not synchronized by clock signals on a line 86. Each of the interrogating signals intended for the pad 42*a* may be identified by an address individual to such pad. When the pad 42*a* receives such interrogating signals, it sends to the central station 64 through lines 88 a sequence of signals indicating the status of the successive ones of the switches 46,48, 50 and 52 and the switches 57, 59, 62*a*, 62*b*, 63*a* and 63*b*. These signals are synchronized by the clock signals on the line 86. It will be appreciated that the status of each of the switches 57 and 59 probably is the first to be provided in the sequence since these signals indicate the selection of the stationary accessories 34 and 38 and the selection of the vehicles 12, 14, 16, and 17.

As previously indicated, the pad 42*a* selects one of the vehicles 12, 14, 16 and 17 in accordance with the number of closings of the switch 59. As the user of the pad 42*a* provides successive actuations or depressions of the button 58, signals are introduced to a shift register 90 through a line 92 to indicate which one of the vehicles 12, 14, 16 and 17 would be selected if there were no further depressions of the button in the particular period of time. Each one of the depressions of the button 58 causes the indication to be shifted to the right in the shift register 90. Such an indication is provided on an individual one of a plurality of light emitting diodes (LED) generally indicated at 93. The shifting of the indication in the shift register 90 may be synchronized with a clock signal on a line 95. Thus, the illuminated one of the light emitting diodes 93 at each instant indicates at that instant the individual one of the vehicles 12, 14, 16 and 17 that the pad 42*a* has selected at such instant within the particular period of time The central station 64 is shown in additional detail in FIG. 3. It includes a microcontroller generally indicated at 94 having a read only memory (ROM) 96 and a random access memory (RAM) 98. As with the memories in the microcontroller 76 in the pad 42*a*, the read only memory 96 stores permanent information and the random access memory 98 stores volatile (or impermanent) information. For example, the read only memory 96 sequentially selects successive ones of the pads 42*a*, 42*b*, 42*c* and 42*d* to be interrogated by the central station on a cyclic basis. The read only memory 96 also stores a plurality of addresses each individual to a different one of the vehicles 12, 14, 16 and 17.

Since the read only memory 96 knows which one of the pads 42*a*, 42*b*, 42*c* and 42*d* is being interrogated at each instant, it knows the individual one of the pads responding at that instant to such interrogation. The read only memory 96 can provide this information to the microcontroller 94 when the microcontroller provides for the transmittal of information to the vehicles 12, 14, 16 and 17. Alternatively, the microcontroller 76 in the pad 42*a* can provide an address indicating the pad 42*a* when the microcontroller sends the binary signals relating to the status of the switches 46, 48, 50 and 52 and the switches 57, 59, 62*a*, 62*b*, 63*a* and 63*b* to the central station 64.

Figure 3:
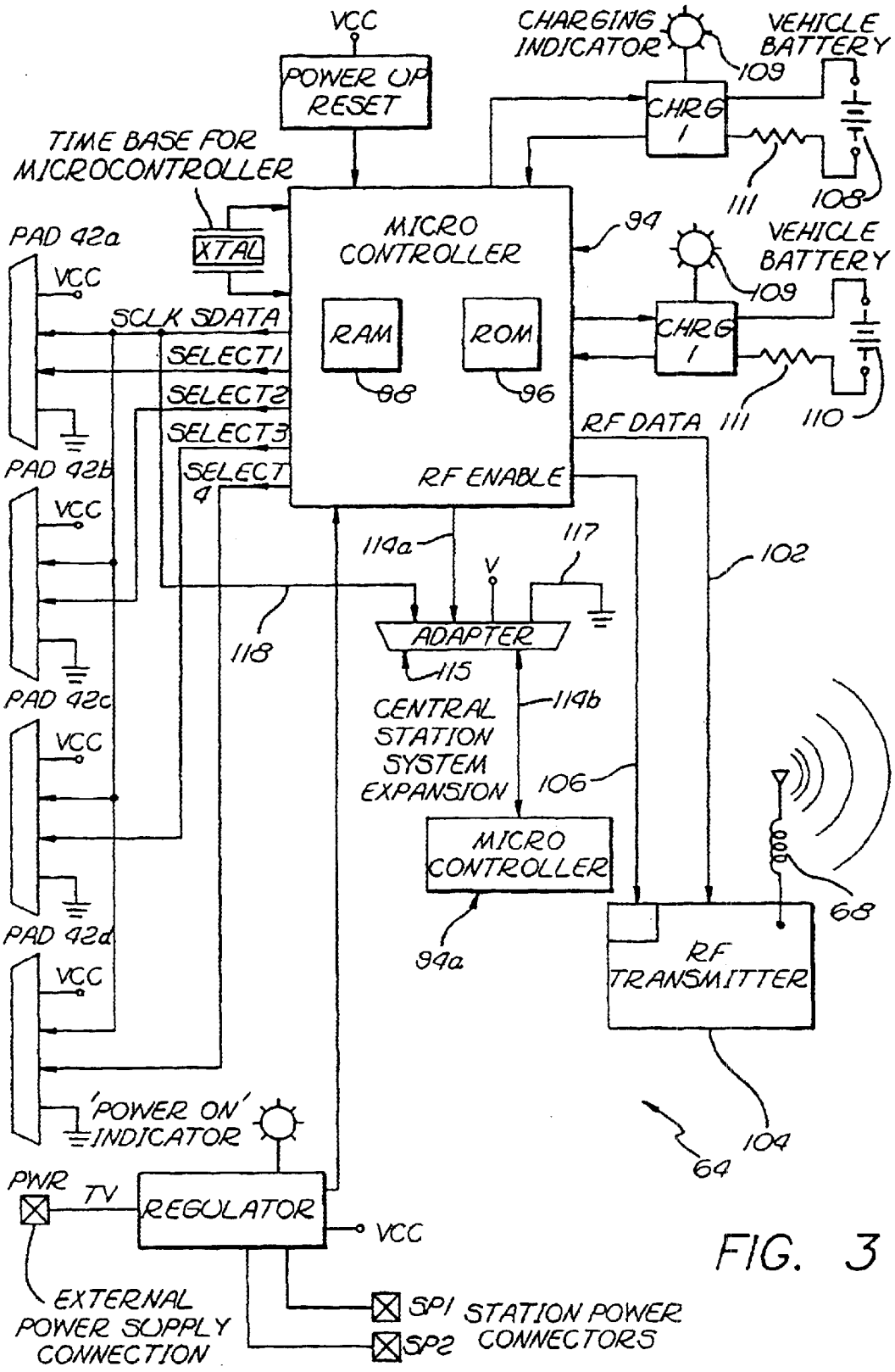
FIG. 3 is a schematic diagram, primarily in block form, of the different features included in a central station included in the system shown in FIG. 1.

As an example of the information stored in the random access memory 98 in FIG. 3, the memory stores information relating to each pairing between an individual one of the pads 42*a*, 42*b*, 42*c* and 42*d* and a selective one of the vehicles 12, 14, 16 and 17 in FIG. 1 and between each individual one of such pads and a selective one of the stationary accessories 34 and 38. The random access memory 98 also stores the status of the operation of switches 46, 48, 50 and 52 for each pad and the operation of the switches 57, 59, 62*a*, 62*b*, 63*a* and 63*b* for that pad.

When the central station 64 receives from the pad 42*a* the signals indicating the closure (or the lack of closure) of the switches 46, 48, 50 and 52 and the switches 57, 59, 62*a*, 62*b*, 63*a* and 63*b*, the central station retrieves from the read only memory 96 the address of the individual one of the vehicles indicated by the closures of the switch 59 in the pad. The central station may also retrieve the address of the pad 42*a* from the read only memory 96.

The central station 64 then formulates in binary form a composite address identifying the pad 42*a* and the selected one of the vehicles 12, 14, 16 and 17 and stores this composite address in the random access memory 98. The central station 64 then provides a packet or sequence of signals in binary form including the composite address and including the status of the opening and closing of each of the switches in the pad 42*a*. This packet or sequence indicates in binary form the status of the closure each of the switches 46, 48, 50 and 52 and the switches 57, 59, 62*a*, 62*b*, 63*a* and 63*b*.

Each packet of information including the composite addresses and the switch closure information for the pad 42*a* is introduced through a line 102 in FIG. 3 to a radio frequency transmitter 104 in the central station 64. The radio frequency transmitter 104 is enabled by a signal passing through a line 106 from the microcontroller 94. This enabling signal is produced by the microcontroller 94 when the microcontroller confirms that it has received signals from the pad 42*a* as a result of the interrogating signals from the central station 64.

When the radio frequency transmitter 104 receives the enabling signal on the line 106 and the address and data signals on the line 102, the antenna 68 (also shown in FIG. 1) transmits signals to all of the vehicles 12, 14, 16 and 17. However, only the individual one of the vehicles 12, 14, 16 and 17 with the address indicated in the packet of signals from the central station 64 will respond to such packet of signals.

The microcontroller 94 stores in the random access memory 98 the individual ones of the vehicles such as vehicles 12, 14, 16 and 17 respectively being energized at such instant by the individual ones of the pads 42*a*, 42*b*, 42*c* and 42*d*. Because of this, the central station 64 is able to prevent the interrogated one of the pads 42*a*, 42*b*, 42*c* and 42*d* from selecting one of the energized vehicles. Thus, for example, when the vehicle 14 is being energized by one of the pads 42*a*, 42*b*, 42*c* and 42*d* at a particular instant, a first depression of the button 58 in the pad being interrogated at that instant will cause the vehicle 12 to be initially selected and a second depression of the button by such pad will cause the vehicle 14 to be skipped and the vehicle 16 to be selected.

Furthermore, in the example above where the pad 42*a* has previously selected the vehicle 14, the microcomputer 94 in the central station 64 will cause the vehicle 14 to be released when the pad 42*a* selects any of the vehicles 12, 16 and 17. When the vehicle 14 becomes released, it becomes available immediately thereafter to be selected by any one of the pads 42*a*, 42*b*, 42*c* and 42*d*. The release of the vehicle 14 by the pad 42*a* and the coupling between the pad 42*a* and a selected one of the vehicles 12, 14, 16 and 17 are recorded in the random access memory 98 in the microcontroller 94.

The vehicles 12, 14, 16 and 17 are battery powered. As a result, the energy in the batteries in the vehicles 12, 14, 16 and 17 tends to become depleted as the batteries provide the energy for operating the vehicles. The batteries in the vehicles 12 and 14 are respectively indicated at 108 and 110 in FIG. 3. The batteries 108 and 110 are chargeable by the central station 64 because the central station may receive AC power from a wall socket. The batteries are charged only for a particular period of time. This particular period of time is preset in the read only memory 96. When each battery is being charged for the particular period of time, a light 109 in a circuit with the battery becomes illuminated. The charging current to each of the batteries 108 and 110 may be limited by a resistor 111. The light 109 becomes extinguished when the battery has been charged.

Each central station 64 may have the capabilities of servicing only a limited number of pads. For example, each central station 64 may have the capabilities of servicing only the four (4) pads 42*a*, 42*b*, 42*c* and 42*d*. It may sometimes happen that the users of the system may wish to be able to service more than four (4) pads. Under such circumstances, the microcontroller 94 in the central station 64 and a microcontroller, generally indicated at 94*a*, in a second central station corresponding to the central station 64 may be connected by cables 114*a* and 114*b* to an adaptor generally indicated at 115.

One end of the cable 114*b* is constructed so as to be connected to a ground 117 in the adaptor 115. This ground operates upon the central station to which it is connected so that such central station is a slave to, or subservient to, the other central station. For example, the ground 117 in the adaptor 115 may be connected to the microcomputer 94*a* so that the central station including the microcomputer 94*a* is a slave to the central station 64. When this occurs, the microcontroller 94 in the central station 64 serves as the master for processing the information relating to the four (4) pads and the four (4) vehicles in its system and the four (4) pads and the four (4) vehicles in the other system.

The expanded system including the microcomputers 94 and 94*a* may be adapted so that the address and data signals generated in the microcomputer 94*a* may be transmitted by the antenna 68 in the central station 64 when the central station 64 serves as the master station. The operation of the central station 64*a* may be clocked by the signals extending through a line 118 from the central station 64 to the adaptor 115 and through a corresponding line from the other central station to the adaptor.

Figure 4:
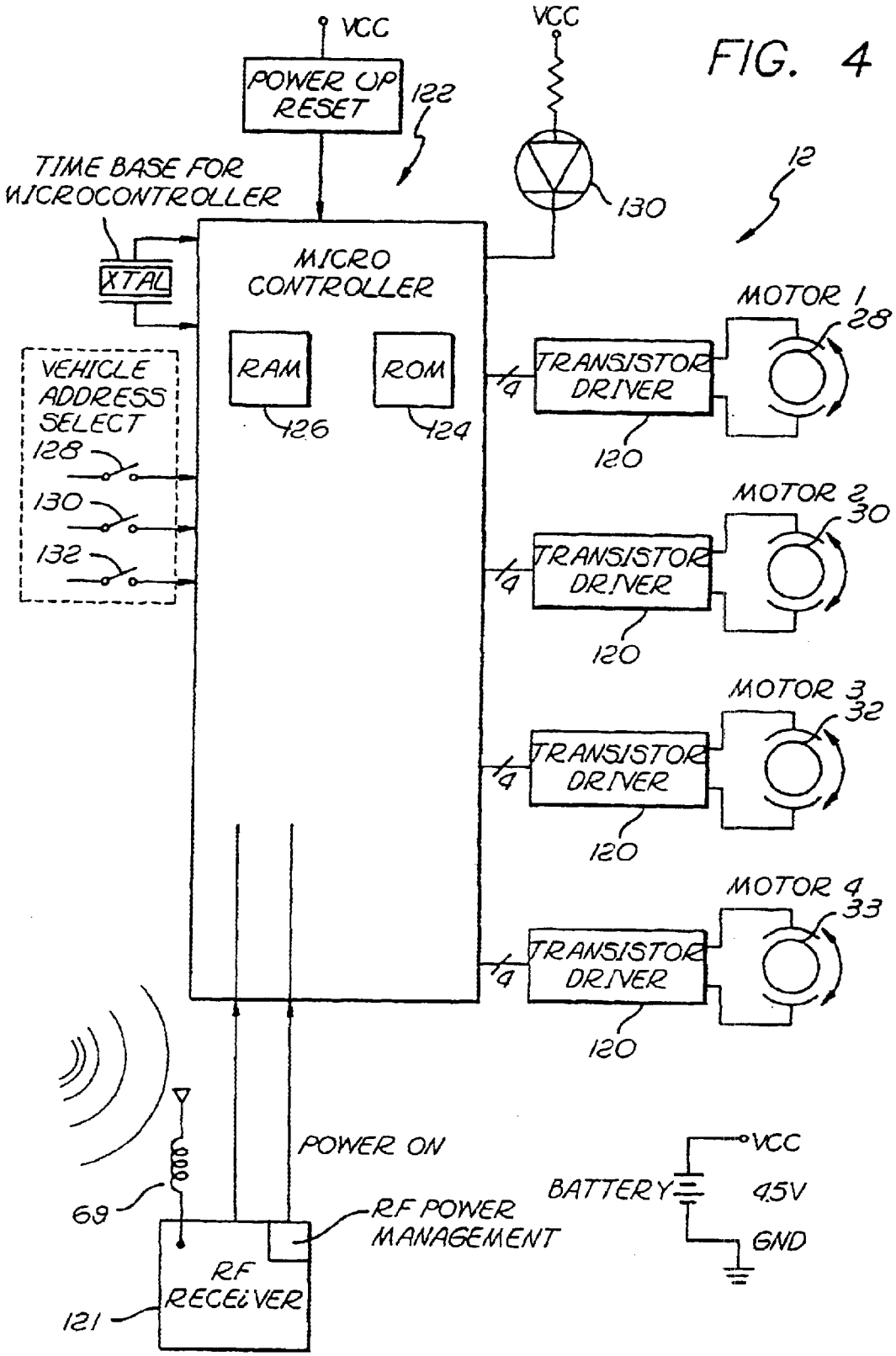
FIG. 4 is a schematic diagram, primarily in block form, of the different features in a vehicle included in the system shown in FIG. 1.

The vehicle 12 is shown in additional detail in FIG. 4. Substantially identical arrangements may be provided for each of the vehicles 14, 16 and 17. The vehicle 12 includes the antenna 69 for receiving from the central station 64 signals with the address of the vehicle and also includes a receiver 121 for processing the received signals. The vehicle 12 also includes the motors 28, 30, 32 and 33. Each of the motors 28, 30, 32 and 33 receives signals from an individual one of transistor drivers 120 connected to a microcontroller generally indicated at 122.

The microcontroller 122 includes a read only memory (ROM) 124 and a random access memory (RAM) 126. As with the memories in the pad 42*a* and the central station 64, the read only memory 124 may store permanent information and the random access memory 126 may store volatile (or impermanent) information. For example, the read only memory 124 may store information indicating the sequence of the successive bits of information in each packet for controlling the operation of the motors 28, 30, 32 and 33 in the vehicle 12. The random access memory 126 stores information indicating whether there is a binary 1 or a binary 0 at each successive bit in the packet.

The vehicle 12 includes a plurality of switches 128, 130 and 132. These switches are generally pre-set at the factory to indicate a particular Arabian number such as the number "5". However, the number can be modified by the user to indicate a different number if two central stations are connected together as discussed above and if both stations have vehicles identified by the numeral "5". The number can be modified by the user by changing the pattern of closure of the switches 128, 130 and 132. The pattern of closure of the switches 128, 130 and 132 controls the selection of an individual one of the vehicles such as the vehicles 12, 14, 16 and 17.

The pattern of closure of the switches 128, 130 and 132 in one of the vehicles can be changed when there is only a single central station. For example, the pattern of closure of the switches 128, 130 and 132 can be changed when there is only a single central station with a vehicle identified by the numeral "5" and when another user brings to the central station, from such other user's system, another vehicle identified by the numeral "5".

The vehicle 12 also includes a light such as a light emitting diode 130. This diode is illuminated when the vehicle 12 is selected by one of the pads 42*a*, 42*b*, 42*c* and 42*d*. In this way, the other users can see that the vehicle 12 has been selected by one of the pads 42*a*, 42*b*, 42*c* and 42*d* in case one of the users (other than the one who selected the vehicle 12) wishes to select such vehicle. It will be appreciated that each of the vehicles 12, 14, 16 and 17 may be generally different from the others so each vehicle may be able to perform functions different from the other vehicles. This is another way for each user to identify the individual one of the vehicles that the user has elected.

As previously indicated, the user of one of the pads such as the pad 42*a* selects the vehicle 12 by successively depressing the button 58 a particular number of times within the particular time period. This causes the central station 64 to produce an address identifying the vehicle 12. When this occurs, the central station 64 stores information in its random access memory 98 that the pad 42*a* has selected the vehicle 12. Because of this, the user of the pad 42*a* does not thereafter have to depress the button 58 during the time that the pad 42*a* is directing commands through the central station 64 to the vehicle 12. As long as the buttons on the pad 42*a* are depressed within a particular period of time to command the vehicle 12 to perform individual functions, the microprocessor 94 in the central station 64 will direct the address of the vehicle 12 to be retrieved from the read only memory 96 and to be included in the packet of the signals transmitted by the central station to the vehicle 12. This particular period of time may be different from the particular period of time for addressing the vehicle.

The read only memory 96 in the microprocessor 94 at the central station 64 stores information indicating a particular period of time in which the vehicle 12 has to be addressed by the pad 42*a* in order for the selective coupling between the pad and the vehicle to be maintained. The random access memory 98 in the microcontroller 94 stores the period of time from the last time that the pad 42*a* has issued a command through the central station 64 to the vehicle 12. When the period of time in the random access memory 98 equals the period of time in the read only memory 96, the microcontroller 94 will no longer direct commands from the pad 42*a* to the vehicle 12 unless the user of the pad 42*a* again depresses the button 58 the correct number of times within the particular period of time to select the vehicle 12. When the pad 42*a* fails to issue a command to the vehicle 12 within the particular period of time, the vehicle 12 becomes converted from an active and powered state to an inactive but powered state.

The vehicle 12 also stores in the read only memory 124 indications of the particular period of time in which the vehicle 12 has to be addressed by the pad 42*a* in order for the selective coupling between the vehicle and the pad to be maintained. This period of time is the same as the period of time specified in the previous paragraph. The random access memory 126 in the microcontroller 122 stores the period of time from the last time that the pad 42*a* has issued a command to the vehicle 12.

As previously indicated, the button 58 in the pad 42*a* does not have to be actuated or depressed to issue the command after the pad 42*a* has initially issued the command by the appropriate number of depressions of the button. When the period of time stored in the random access memory 126 of the microcomputer 122 in the vehicle equals the period of time in the read only memory 124, the microcontroller 122 issues a command to extinguish the light emitting diode 130. This indicates to the different users of the system, including the user previously controlling the operation of the vehicle 121, that the vehicle is available to be selected by one of the users including the user previously directing the operation of the vehicle.

When one of the vehicles such as the vehicle 12 is being moved in the forward direction, the random access memory 126 records the period of time during which such forward movement of the vehicle 12 is continuously occurring. This period of time is continuously compared in the microcontroller 122 with a fixed period of time recorded in the read only memory 124. When the period of time recorded in the random access memory 126 becomes equal to the fixed period of time recorded in the read only memory 124, the microcontroller 122 provides a signal for changing the speed of the movement of the vehicle 12 in the forward direction. Similar arrangements are provided for each of the vehicles 14, 16 and 17. This change in speed may illustratively be twice that of the original speed. It will be appreciated that the change in speed may constitute a decrease in the speed of the vehicle 42*a*.

The system and method described above and disclosed and claimed in U.S. Pat. No. 5,944,607 have certain important advantages. They provide for the individual operation of a plurality of vehicles (e.g., the vehicles 12, 14, 16 and 17) by a plurality of users, either on a competitive or a cooperative basis. Furthermore, the vehicles can be operated on a flexible basis in that a vehicle can be initially selected for operation by one user and can then be selected for operation by another user after the one user has failed to operate the vehicle for a particular period of time. The vehicles being operated at each instant are also easily identified visually by the illumination of the lights 130 on the vehicle. The apparatus and method of this invention are also advantageous in that the vehicles are operated by the central station 64 on a wireless basis without any physical or cable connection between the central station and the vehicles.

Furthermore, the central station 64 is able to communicate with the vehicles in the plurality through a single carrier frequency. The system and method are also advantageous in that the vehicles can selectively perform a number of different functions including movements forwardly and rearwardly and to the left and the right and including movements of a container or bin or platform on the vehicle upwardly and downwardly or to the left or the right. Different movements can also be provided simultaneously in any one of the addressed vehicles on a coordinated basis.

There are also other significant advantages in the system and method in the preferred embodiments of this invention. Two or more systems can be combined to increase the number of pads 42 controlling the operation of the vehicles 12, 14, 16 and 17. In effect, this increases the number of users capable of operating the system. This combination of systems can be provided so that one of the systems is a master and the other is a slave. This prevents any confusion from occurring in the operation of the system. The system is also able to recharge the batteries in the vehicles so that use of the vehicles can be resumed after the batteries have been charged.

The system and method in the preferred embodiments of this invention are also advantageous in the provision of the pads 42 and the provision of the buttons and switches in the pads. As will be appreciated, the pads 42 are able to select vehicles and/or stationary accessories through the operation of a minimal number of buttons and to provide for the operation of a considerable number of different functions in the vehicles with a minimal number of buttons. In cooperation with the central station 64, the pads 42 are able to communicate the selection of vehicles (e.g., 12, 14, 16 and 17) to the central station 64 without indicating to the central station, other than on a time shared basis, the identities of the vehicles being selected. After selecting a vehicle, each pad does not thereafter have to indicate the identity of the vehicle as long as the pad operates the vehicle through the central station within a particular period of time from the last operation of the vehicle by the pad through the central station.

Figure 8:
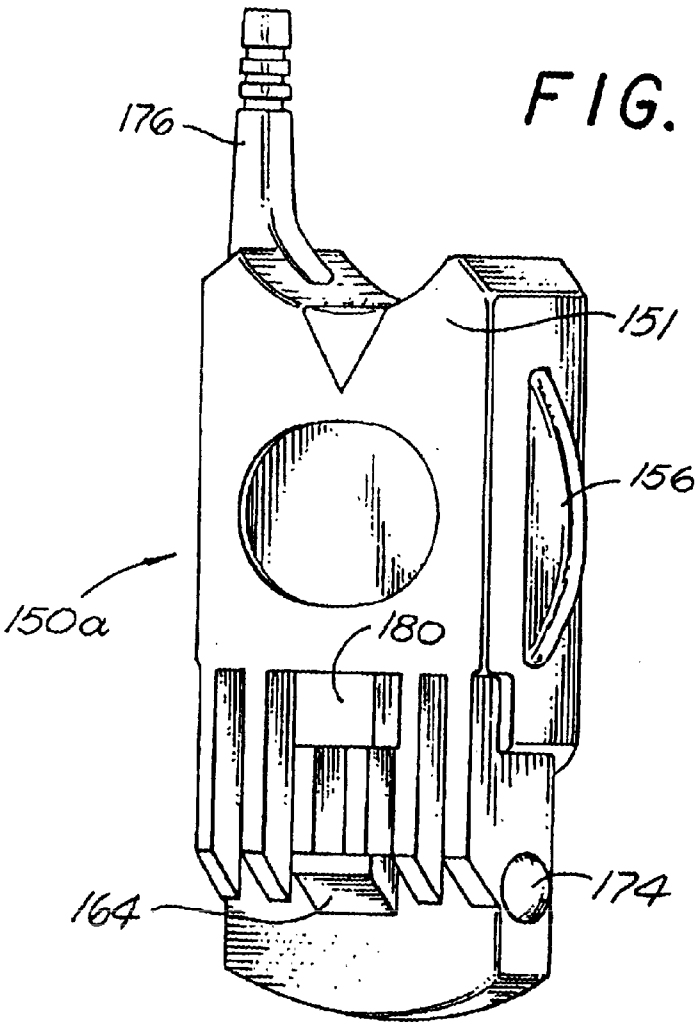
FIG. 8 is an enlarged perspective view of the key as seen from a position in back of and to one side of the key.
Figure 7:
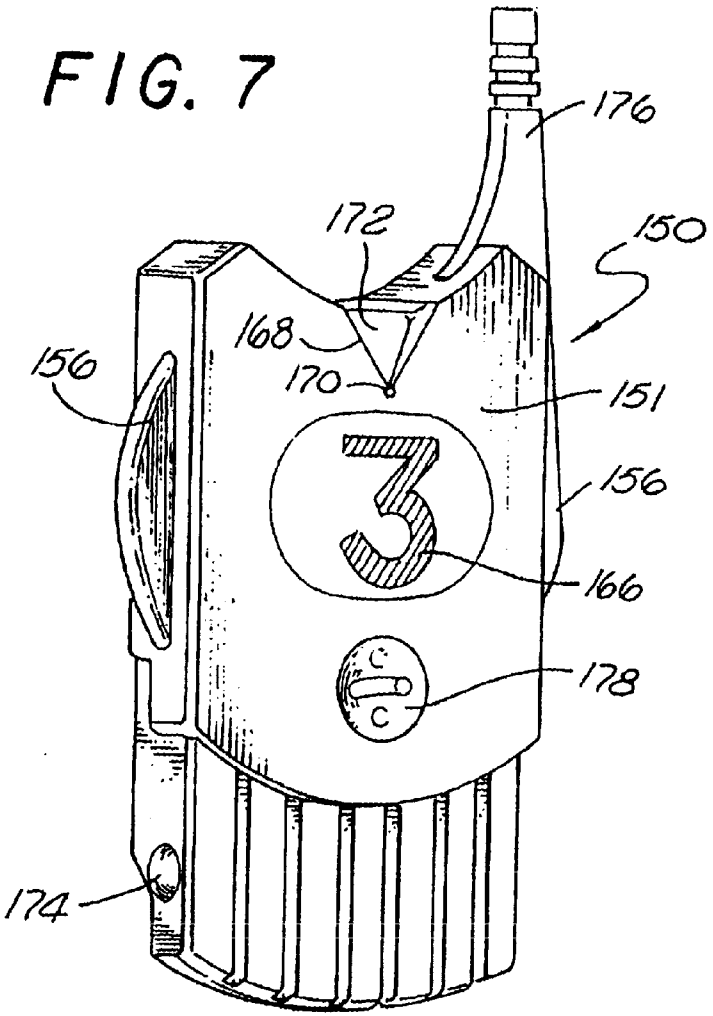
FIG. 7 is an enlarged perspective view of the key as seen from a position in front of and to one side of the key.
Figure 9H:
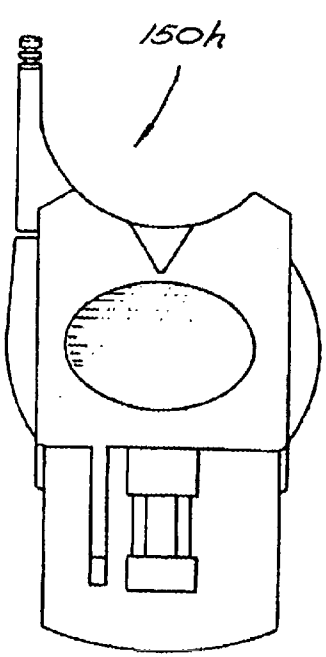
Figure 10H:
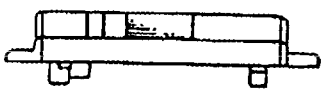
Figure 9G:
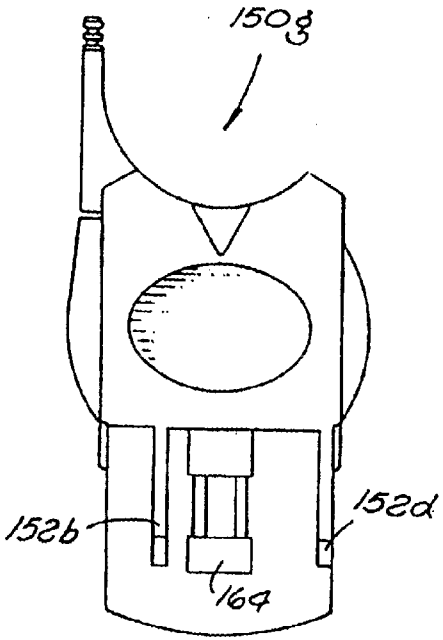
Figure 10G:
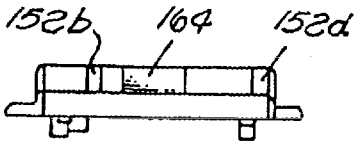
Figure 9F:
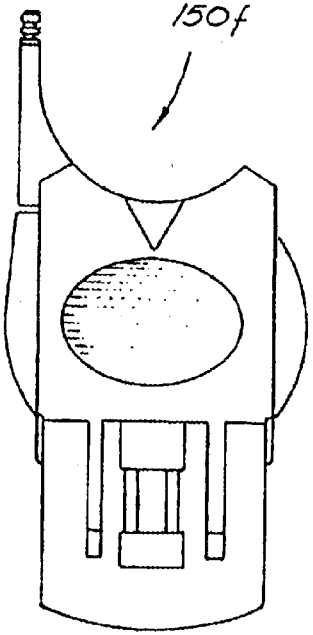
Figure 10F:
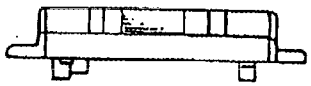
Figure 9E:
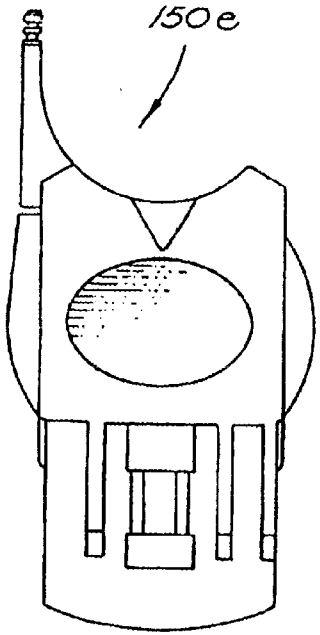
Figure 10E:
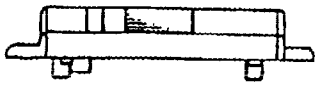

The preferred embodiments of this invention provide an improved system for providing selectable addresses in the vehicles 12, 14, 16 and 17. The preferred embodiments of the invention include a plurality of keys generally indicated at 150 and individually indicated at 150*a*, 150*b*, 150*c*, 150*d*, 150*e*, 150*f*, 150*g* and 150*h* in FIGS. 9 and 10. Each of the keys may have substantial dimensions so that they will not be easily lost by children using the vehicles. For example, the height of each key may be about three inches (3") and the width of each key may be about one and one half inches (1 ½'). The thickness of each key may be relatively small. Each key may be disposed in a vehicle (e.g., the vehicles 12, 14, 16 and 17) which has a length of about six inches (6") and a width of about three inches (3") and a height of about three inches Each of the keys 150 has a body 151 (FIGS. 7 and 8). As will be seen from the subsequent discussion, each of the keys 150 is constructed to provide an address individual to that key. This may be seen from the following table where the left column indicates the individual ones of the keys 150*a*–150*h* and the right column indicates an address individually distinguishing each of the keys from the others:

| Key | Individual Address |
|---|---|
| 150a | 1 |
| 150b | 2 |
| 150c | 3 |
| 150d | 4 |
| 150e | 5 |
| 150f | 6 |
| 150g | 7 |
| 150h | 8 |

Although the individual address for each key is shown as an Arabian integer, it will be appreciated that the individual address for such vehicle will probably be in an individual pattern of binary signals.

The body 151 on each of the keys 150*a*–150*h* is provided with an individual pattern of ribs 152*a*, 152*b*, 152*c* and 152*d*. (FIGS. 9 and 10). This may be seen from the following table indicating the individual pattern of ribs for each of the keys 150*a*–150*h*:

| Key | Individual Address-Pattern of Ribs |
|---|---|
| 150a | 152a, 152b, 152c, 152d |
| 150b | 152a, 152b, 152c |
| 150c | 152a, 152b, 152d |
| 150d | 152a, 152b |
| 150e | 152b, 152c, 152d |
| 150f | 152b, 152c |
| 150g | 152b, 152d |
| 150h | 152b |

It will be appreciated that sixteen (16) different combinations may be provided with the four (4) ribs 152*a*–152*d*. Only eight (8) combinations are shown in the table above and in FIGS. 9*a*–9*h* and 10*a*–10*h* on the assumption that the system will contain only eight (8) vehicles. However, sixteen (16) different vehicles may be identified by the different patters of the ribs 152*a*–152*d*. It will also be appreciated that a different number of ribs then four (4) may be provided to change the number of vehicles that can be provided in the system.

Figure 11:
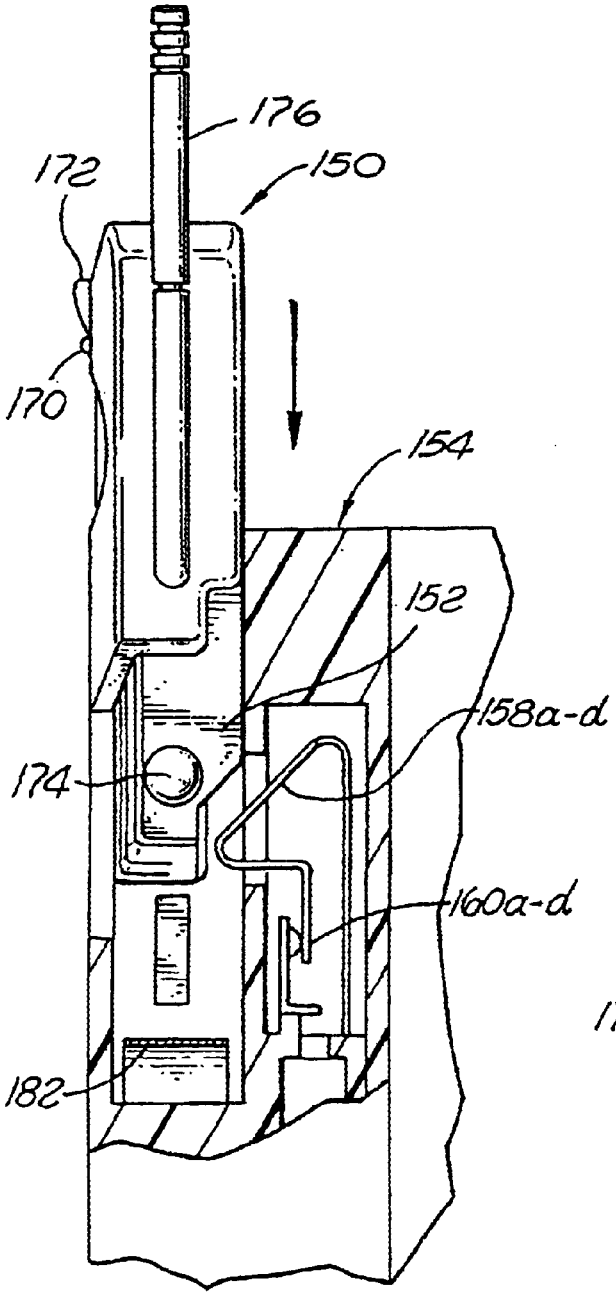
FIG. 11 is a fragmentary side elevational view, partly in section, of a vehicle and a key with the key partially inserted into a socket in the vehicle and shows the disposition of first switches in the vehicle with such partial insertion of the key into the socket.
Figure 12:
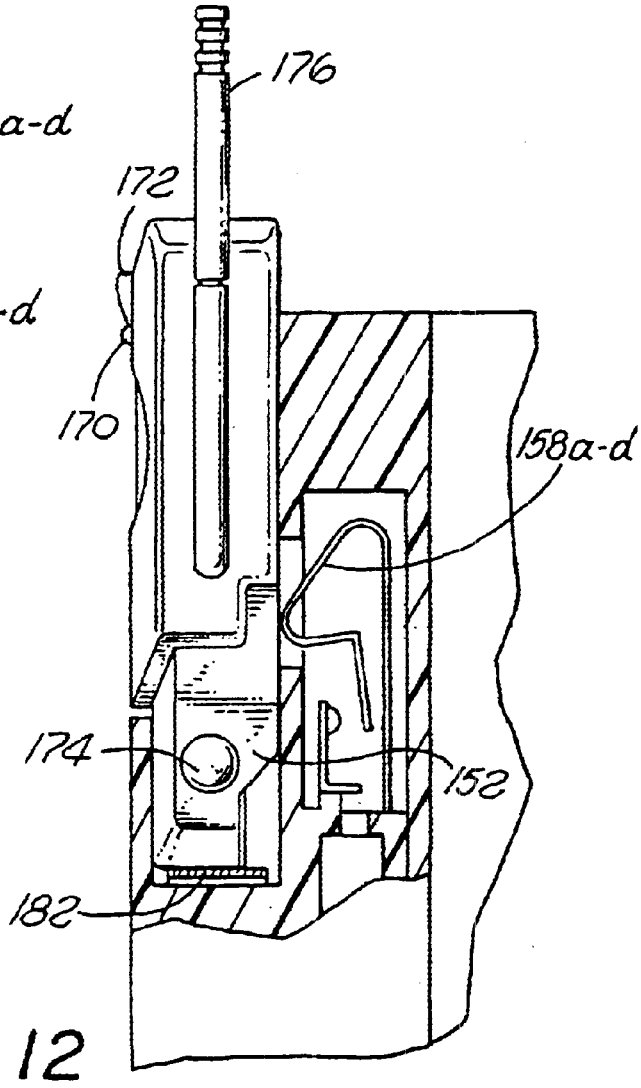
FIG. 12 is a fragmentary side elevational view, partly in section, of the vehicle and key shown in FIG. 11 and is similar to FIG. 11 except that it shows the key fully inserted into the socket in the vehicle and shows the disposition of the first switches in the vehicle with such full insertion of the key into the socket.

Each of the keys 150*a*–150*h* is adapted to be disposed in a socket 154 (FIGS. 5 and 6) in any one of the vehicles 12, 14, 16 and 17. Each of the keys 150*a*–150*h* may be provided with guides 156 at its opposite sides (1) to fit in slots 157 in the socket and provide for a snug fit of the keys in the socket 154, (2) to provide for a controlled movement of the key into the socket, (3) to provide lateral stability to the key after the disposition of the key in the socket and (4) to prevent the key from coming out of the socket except by manual removal of the key from the socket. When one of the keys 150 (e.g. the key 150*d*) is disposed in the socket 154 of one of the vehicles (e.g. the vehicle 12), the ribs 152*a* and 152*b* in the key 150*d* engage springs 158*a* and 158*b* (FIGS. 11 and 12) operatively coupled to the movable contacts of a pair of switches 160*a* and 160*b* (included in a bank of switches 160*a*, 160*b*, 160*c* and 160*d*) and move these contacts from engagement with the stationary contacts of the switches. As a result, only the switches 160*c* and 160*d* remain closed. This causes the vehicle 12 to have an address identified by a binary pattern of 0011. As will be seen from the subsequent discussion, any one of the pads 42*a*, 42*b*, 42*c* and 42*d* can select the vehicle 12 by three (3) manual depressions of the button 58 in such pad within a particular period of time. The manual depression of the button 58 in the pad three (3) times within the particular period of time provides for the binary address of 0011 where the least significant bit is at the right.

The number of manual depressions of the button 58 to select an individual one of the vehicles may actually be dependent upon the previous actuation of the button. For example, the button 58 in a pad may have been previously actuated twice to select the vehicle identified by the number "2". If the user of such pad now desires to select the vehicle identified by the numeral "3", such user would only have to actuate the button 58 once. Similarly, if the user has previously selected the vehicle identified by the numeral "2" by actuating the pad twice and now desires to select vehicle identified by the numeral "1" the user would have to actuate the button 58 in the pad an additional seven (7) times.

An electrically conductive shorting bar 164 (FIGS. 8 and 9) is disposed between the ribs 152*a* and 152*b* and the ribs 152*c* and 152*d*. The bar 164 engages a pair of contacts 166*a* to the microcontroller 122 in the vehicle 12. This causes the microcontroller 122 in the vehicle 12 to reset all of the different parameters in the random access memory 126 to initializing values. For example, the random memory 126 in the vehicle 12 may be set to initializing values of zero (0) for the switches 160*a*–160*d*. After a brief period of time (e.g. ½ second) provided in the microcontroller 122, the microcontroller may then cause the pattern of 0011 to be provided in the random access memory 126 in the vehicle 12 in accordance with the pattern of the ribs in the key 150*d*.

A decal 166 (FIGS. 5 and 7) is disposed on the front and the rear of each of the keys 150 to identify that key by an individual Arabian number. For example, the Arabian number "3" is provided on the decal 166 which is disposed on the front of the key 150*d* to identify such key and distinguish such key from the other keys. A V-shaped cut 168 is provided on the top of each key 150 at the front and rear of the key. A light emitting diode (LED) 170 is disposed in each of the keys 150 at a position just below the neck of the V-shaped cut 168. A clear light conducting plastic 172 is disposed in the V-shaped cut 168 to conduct light from the light emitting diode 170. Electrically conductive pins 174 are provided on the opposite sides of each of the keys 150 near the bottom of the key to establish a continuous circuit to the light emitting diode 170 when the key is inserted in the socket 154 in the vehicle such as the vehicle 12.

A finger 176 made from a suitable material such as rubber and looking like an antenna (but not actually an antenna) may extend upwardly from the top of each of the keys 150. The finger 176 is provided to add a semblance of high level technology to the key 150, particularly for young children. However, the finger 176 has no utility in the key. A button 178 below the decal 166 also has no utility in the key.

When the key 150*d* is inserted into the socket 154 of the vehicle 12, the bar 164 establishes an electrical circuit across the switches 166*a* and 166*b* and causes the microcontroller 122 to initialize all of the parameters in the random access memory 126 and to initialize the address of the vehicle in the random access memory 126. Although the switches 150*b* and 150*d* are closed at the same time as the switches 166*a* and 166*b*, the microcontroller 122 in the vehicle 12 does not establish the address of the vehicle in the random access memory 126 until after the parameters have been initialized by the closure of the switches 166*a* and 166*b* as discussed above.

The microcontroller 122 causes the vehicle 12 to operate in the inactive but powered state when the address of the vehicle 12 has been entered into the random access memory 126 as a result of the disposition of the key 150*d* in the socket 154. In the inactive but powered state, the vehicle 12 is capable of receiving from any of the pads 42*a*, 42*b*, 42*c* and 42*d* the address entered into the random access memory 126. When the vehicle 12 receives this address from an individual one of the pads 42*a*–42*d*, it operates thereafter in accordance with commands received from such individual one (e.g. the pad 42*b*) of the pads.

The light emitting diode 170 is continuously illuminated in accordance with instructions from the microcontroller 122 during the time that the individual one of the pads 42*a*–42*d* (e.g. the pad 42*b*) is operating the vehicle. This illumination is visible to the users of all of the pads 42*a*–42*d* because of the diffusion of the light from the light emitting diode 170 through the light conducting plastic 172. It indicates to all of the users that the vehicle 12 is being commanded by one of the pads (e.g. the pad 42*b*) and is not available to be operated by any of the other pads.

The continuous illumination of the light emitting diode 170 exists as long as the user of the pad 42*b* continues to issue commands to the vehicle 12 within a first particular period of time after the last time that such pad has issued a command to such vehicle. If the pad 42*b* fails to issue any command to the vehicle 12 within such first particular period of time, the microcontroller 122 in the vehicle 12 causes the vehicle to become operative in the inactive but powered state. In this state, the vehicle is able to be selected by any of the pads including the pad 42*b*. In the inactive but powered state of the vehicle 12, the microcontroller 122 causes the light emitting diode 170 to be illuminated periodically. In other words, the light emitting diode 170 is blinked on and off at a particular rate.

When the vehicle 12 is in the inactive but powered state, it can be addressed by any of the pads 42*a* –42*d* including the pad 42*b*, which previously addressed the vehicle. Assume that the pad 42*c* addresses the vehicle 12 while the vehicle is in the inactive but powered state. The vehicle 12 will now be commanded by the pad 42*c* to operate until such time as the pad 42*c* fails to issue a command to the vehicle within the first particular period of time after the last issuance of a command from the pad to the vehicle. The vehicle will also operate in the inactive but powered state when the pad 42*a* has previously selected and operated the vehicle and the pad now selects and operates a different vehicle such as the vehicle 14. The microcontroller 94 in the central station keeps account of this.

As will be seen, the vehicle 12 is in the inactive but powered state under three (3) different circumstances. One circumstance occurs when one of the keys 150 is inserted in the socket 154 in the vehicle 12. The second circumstance occurs when one of the pads (e.g. the pad 42*a*) selects the vehicle 12 and then fails to issue a command to the vehicle within the first particular time after the last issuance of a command from the pad to the vehicle. The third circumstance occurs when one of the pads (e.g., the pad 42*a*) has previously selected and operated the vehicle 12 and the pad thereafter selects and operates a different vehicle (e.g., the vehicle 14) then the vehicle 12.

The vehicle 12 is programmed to remain n the inactive but powered state for a second particular period of time independent of the first particular period of time. If the vehicle 12 is not addressed by any of the pads 42*a* –42*d* in the second particular period of time, the vehicle becomes deactivated. Alternatively, if no commands have been given by any of the pads 42*a* –42*d* to any of the vehicles in the second particular period of time, all of the vehicles become deactivated. When the vehicle 12 becomes deactivated, the light emitting diode 170 is not illuminated. This indicates to the users that power has been removed from the vehicle and that the vehicle is in the depowered state.

Figure 15:
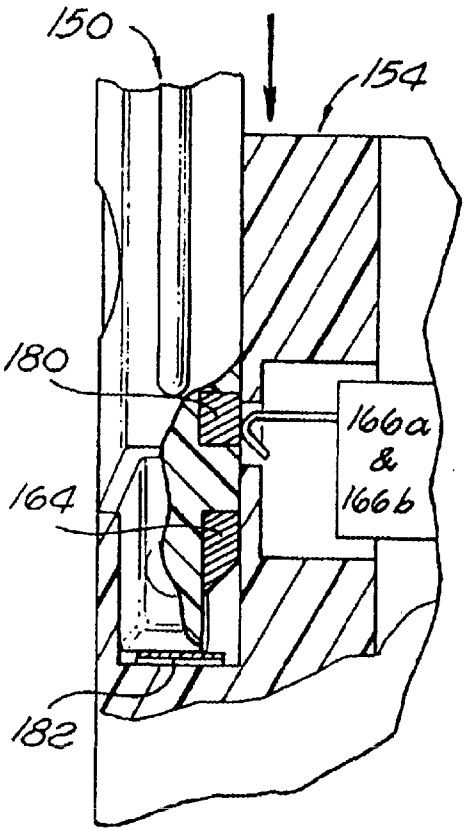
FIG. 15 is a fragmentary side elevational view, partly in section, of the vehicle and the key shown in FIGS. 11–14 and shows a third particular disposition of the key in the vehicle socket and the disposition of the electrical contacts in the vehicle with the key in the third particular disposition in the vehicle socket.

As previously described, the bar 164 establishes an electrical continuity between the switches 166*a* and 166*b* when the key 150 is inserted into the socket 154 in the vehicle 12. To insure that the ribs 152*a* and 152*b* in the key 150*d* will continue to engage the movable contacts of the associated switches 160*a* and 160*b*, the key 150*d* continues to move into the socket 154 to a position between the bar 164 and a bar 180 directly above the bar 164. This is indicated in FIG. 15. The bar 180 corresponds in construction and operation to the bar 164. In the position shown in FIG. 15, the contacts 166*a* and 166*b* are not shorted.

Figure 14:
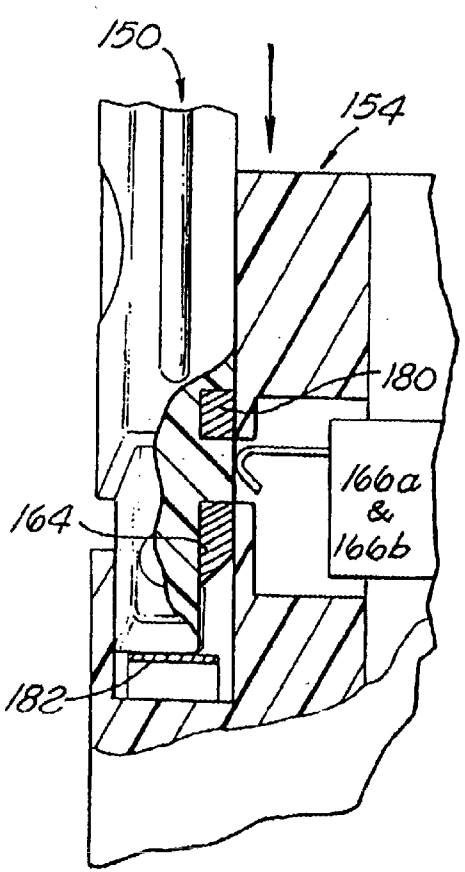
FIG. 14 is a fragmentary side elevational view, partly in section, of the vehicle and the key shown in FIGS. 11–13 and shows a second particular disposition of the key in the vehicle socket and the disposition of the electrical contacts in the vehicle with the key in the second particular disposition in the vehicle socket.

If the vehicle 12 should become deactivated as discussed above and a user should thereafter wish to operate the vehicle, the user presses the key 150*d* downwardly until the bar 180 engages the contacts 166*a* and 166*b*. This is shown in FIG. 15. This causes the contacts 166*a* and 166*b* to be shorted, causing the microcontroller 122 to be initialized and the random access memory 126 to receive the address of the key 150*d*. The vehicle 12 then becomes operative in the inactive but powered state as discussed above. When the key 150*d* is released, the key is moved by the action of a spring 182 back to a position where the contacts are between the bars 164 and 180 in displaced relationship to the bars. This position is shown in FIG. 15. In this way, the key 150*d* can be moved downwardly again into continuity with the contacts 166*a* and 166*b* (which constitute a switch with the bar 164 or the bar 180) if the vehicle should thereafter be deactivated again. This continuity is established by the action of the bar 180 on the switches 166*a* and 166*b* as shown in FIG. 14.

Figure 13:
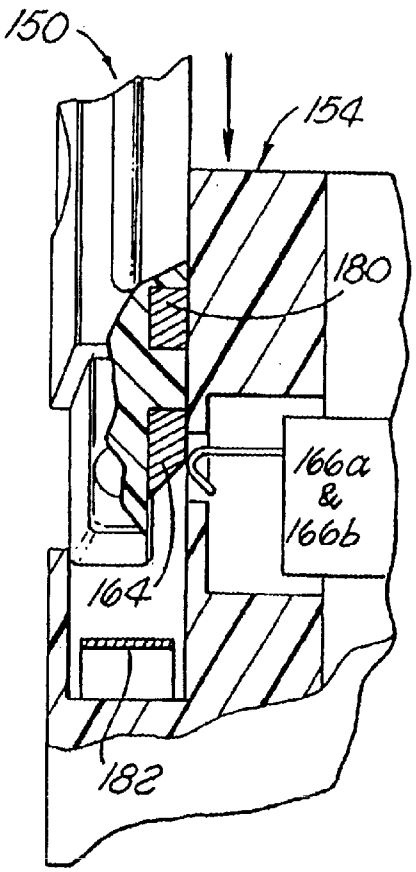
FIG. 13 is a fragmentary side elevational view, partly in section, of the vehicle and the key shown in FIGS. 11 and 12 and shows a first particular disposition of the key in the vehicle socket and the disposition of electrical contacts in the vehicle with such a relationship between the key and the vehicle.

FIG. 13 shows the key in position in the socket so that the bar 164 establishes continuity with the contacts 166*a* and 166*b*. FIG. 14 shows the key in position in the socket so that non-conductive material in the key engages the contacts 166*a* and 166*b*. In this position, no electrical continuity is established between the contacts 166*a* and 166*b*. FIG. 15 shows the key in position in the socket so that the bar 180 establishes continuity with the contacts 166*a* and 166*b*.

The system and method disclosed above have certain important advantages. They provide for the insertion of one of the keys 150 (e.g. the key 150*d*) into the socket 154 in one of the vehicles (e.g. the vehicle 12) to provide the vehicle with an address individual to such key. They also provide for the initializing of the parameters in the random access memory 126 in the vehicle 12. The vehicle 12 can then be selected by any of the pads 42*a* –42*b* by operating the button 58 a number of times dependent upon the individual number (e.g. "3") provided for the vehicle by the key 150*d*.

The system and method disclosed above have other important advantages. They provide for the operation of the vehicle 12 by the pad 42*a* (by way of example) after the vehicle is selected by the pad. If the pad 42*a* fails to operate the vehicle within the first particular period of time, the vehicle becomes inactive but powered and can be selected by any of the pads including the pad 42*a*. If any of the three (3) circumstances discussed above then occurs, the vehicle becomes deactivated. The vehicle can again become inactive but powered by pressing the key 150*d* downwardly in the socket 154.

Figure 16:
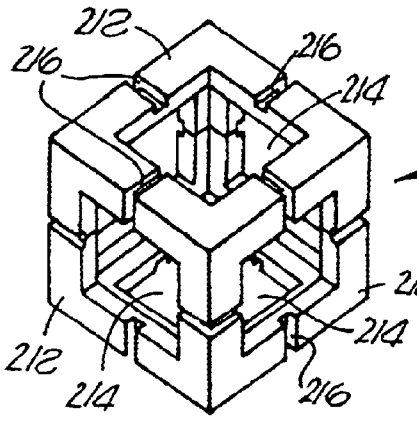
FIG. 16 is a perspective view of a block constituting one of the basic members for building a complex structure of any desired creativity for supporting the vehicles shown in the previous Figures.
Figure 17:
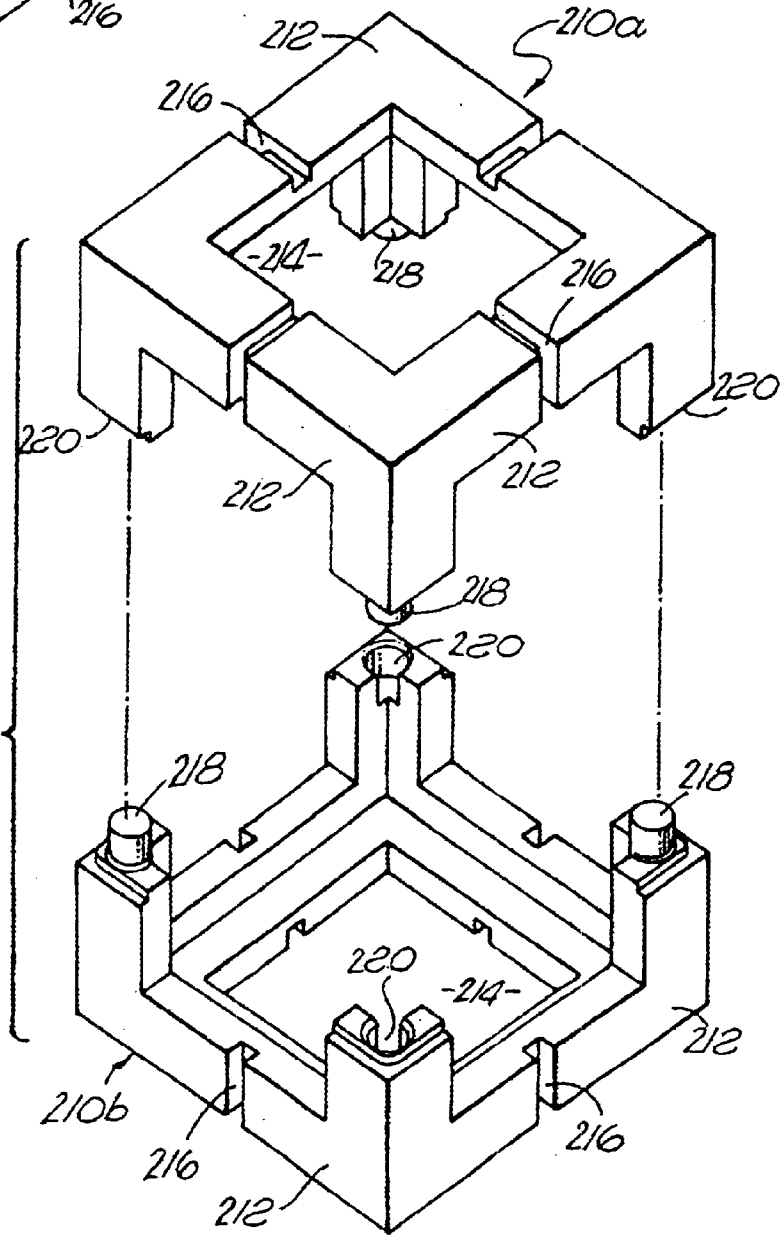
FIG. 17 is an enlarged exploded perspective view of two (2) duplicative sections which can be combined to form the block shown in FIG. 15.

In a preferred embodiment of the invention, a hollow block generally indicated at 210 (FIGS. 16 and 17) is provided. The block 210 may be made from a suitable thermoplastic material such as an acrylonitrile-butadiene-styrene (ABS). The block may preferably be in the form of a rectangular prism with six (6) substantially identical faces 212. Each of the faces 212 may have a configuration of a square with a suitable length such as approximately twenty millimeters (20 mm) for each side of the square, a thickness of approximately two millimeters (2 mm) and a centrally disposed square openings 14 of approximately twelve millimeters (12 mm) for each side of the opening.

Openings 214 are preferably provided in each of the faces 212. It will be appreciated, however, that the opening 214 may be provided in any number of the faces from one (1) to six (6). A number of the blocks 210 may be provided with the openings 214 in only a limited number of the faces 212. Of course, limiting the number of the faces 212 with the openings 214 in the blocks 210 limits the utility which can be provided for the blocks. Grooves 216 may be provided in the faces 212 for decorative purposes.

The blocks 210 may be formed in two sections respectively designated as 210*a* and 210*b*. The sections 210*a* and 210*b* may be identical although this is not a requirement. Each of the sections 210*a* and 210*b* may be provided with pegs 218 at a pair of diagonally opposite ends of such section. Each of the sections 210*a* and 210*b* may also be provided with sockets 220 at the other pair of the diagonally opposite ends of such section. The pegs 218 on each of the sections 210*a* and 210*b* are adapted to fit snugly in the sockets 220 in the other one of the sections 210*a* and 210*b*. The sections 210*a* and 210*b* may then be joined to each other as by brazing or locally heating the pegs 218 and 220 to a temperature for melting and fusing the pegs and the sockets or they may be joined by any other method well known in the art. Alternatively, the pegs 210 may be provided in the section 210*a* and the sockets 220 may be provided in the other section 210*b*.

A beam generally indicated at 222 (FIGS. 18 and 19) is adapted to be used in conjunction with the block 210. The beam 222 may be made from a suitable thermoplastic material such as an acrylonitrile-butadiene-styrene (ABS). The beam may preferably be in the form of a rectangular prism with four (4) substantially identical faces 224 defining a rectangle in section and with two substantially identical end faces 226 in opposed relationship at the opposite ends of the faces 224.

The beam 222 may also be formed in two sections 222*a* and 222*b* in a manner similar to the formation of the block 210. For example, each of the beam sections 222*a* and 222*b* may be provided with diametrically disposed pegs 223 for each of the sections 222*a* and 222*b* and with a pair of diametrically disposed sockets 225 for receiving the pegs 223 in the other one of the beam sections 222*a* and 222*b*. After the pegs 223 in each of the sections 222*a* and 222*b* have been press fitted into the sockets 225 in the other one of the sections 222*a* and 222*b*, the two sections may be attached to each other as by brazing or by heating the pegs 223 and the sockets 225 to melt and fuse the pegs and the sockets or by any other suitable method well known in the prior art. Alternatively, the pegs 223 may be provided in the beam section 222*a* and the sockets 225 may be provided in the beam section 222*b*.

Each of the faces 224 may have a plurality of face sections 224*a*, 224*b*, etc. and a plurality of openings 228*a*, 228*b*, etc., respectively corresponding to the openings 214 in the faces 212 of the block 210. Each of the openings 228*a*, 228*b*, etc. is respectively provided in one of the face sections 224*a*, 224*b*, etc. Each of the openings 228*a*, 228*b*, etc. in the beam 222 may be substantially identical to the openings 214 in the block 210. Although seven (7) openings are shown in each of the faces 224, the number of openings in each face 224 may be different from seven (7) without departing from the scope of the invention. Furthermore, the openings 228 do not have to be provided in every face. For example, the openings 228 may be provided in only one (1) of the faces 224 without departing from the scope of the invention.

Figure 20:
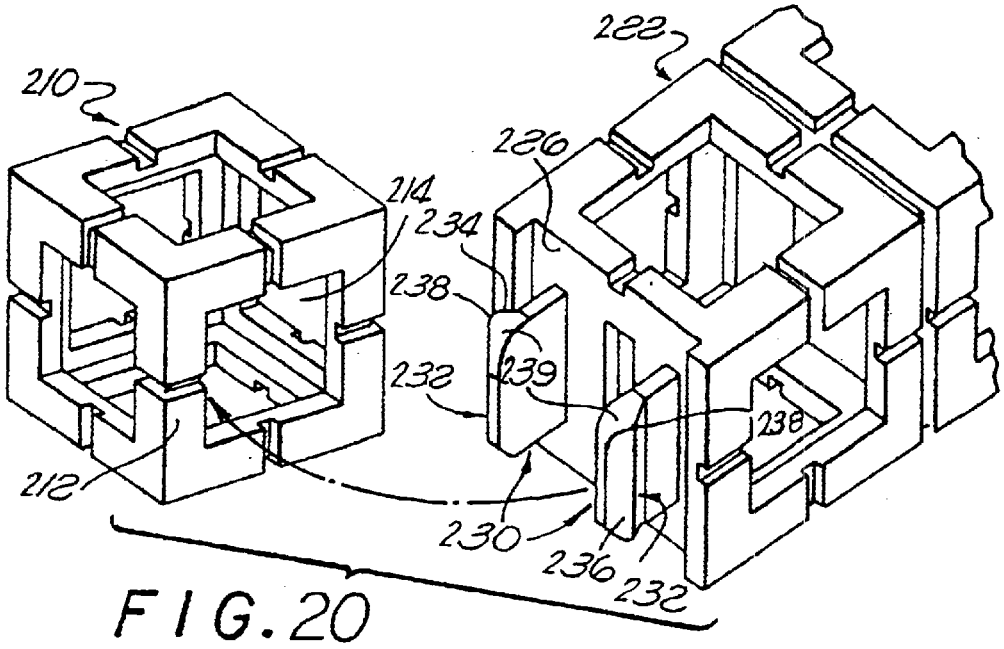
FIG. 20 is a schematic perspective view of the block and the beam in an exploded relationship and shows how the beam can be coupled to the block.
Figure 21:
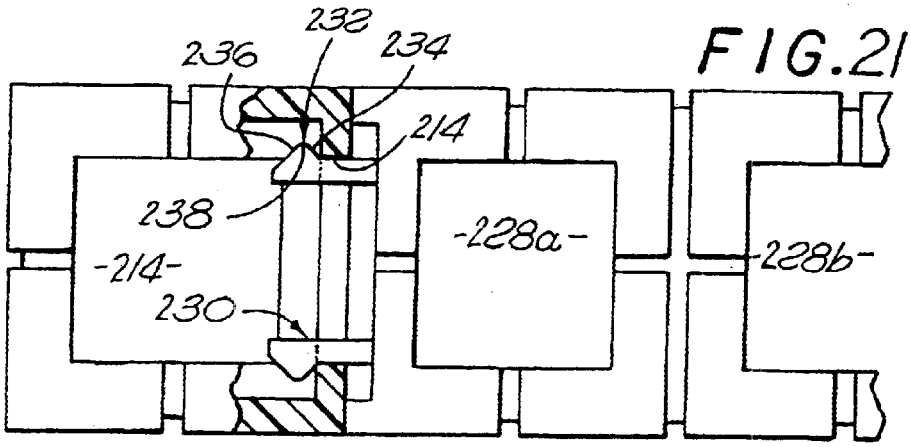
FIG. 21 is an elevational view of the block and the beam in a coupled relationship with the block partially broken away to show how the block and the beam are coupled to each other.

Snaps generally indicated at 230 are preferably provided in the two (2) end faces 226. Preferably two (2) snaps 230 extend from each of the end faces 226. The snaps 230 on each of the end faces 226 are substantially identical and are substantially parallel to each other. Each of the snaps 230 has at its outer end a portion which may be considered as a detent 232 (FIGS. 20 and 21). Each detent 232 has a first portion 234 which progressively increases in thickness with progressive distances from the end faces 226. Each of the detents 232 has a second portion 236 which progressively decreases in thickness with progressive distances from the end faces 226. The first detent portion 234 and the second detent portion 236 have a common boundary 238 at the positions of their maximum thicknesses. As will be seen, the detent portions 232 and 234 of each snap 230 have a bulbous shape.

Figure 22:
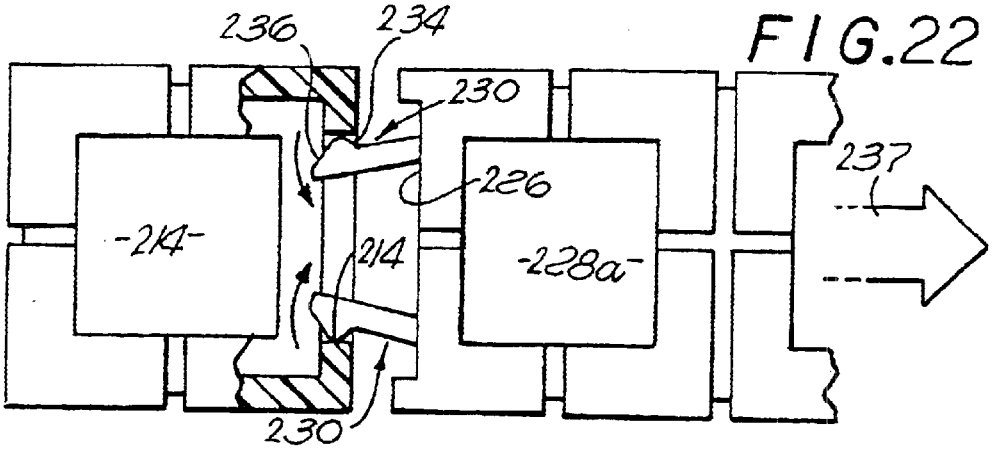
FIG. 22 is a view similar to that shown in FIG. 21 and shows the beam partially removed from the block when a force indicated by an arrow is imposed on the beam in a direction away from the block.

The snaps 230 are constructed to be inserted into the openings 214 in the block 210. The progressive increase in thickness of the detent portion 236 facilitates this insertion. When the snaps 230 have been inserted into one of the openings 214, the detent portions 234 and 236 are disposed internally of the internal surface of the face 212 defining such opening. The snaps 230 may also be removed easily from the opening 214 in the face 212 by pulling the snaps outwardly from the opening. This is indicated by an arrow 237 in FIG. 22. The progressive increase in the thickness of the detent portions 234 in the snaps 230 facilitates the removal of the snaps from the opening 214.

Figure 23:
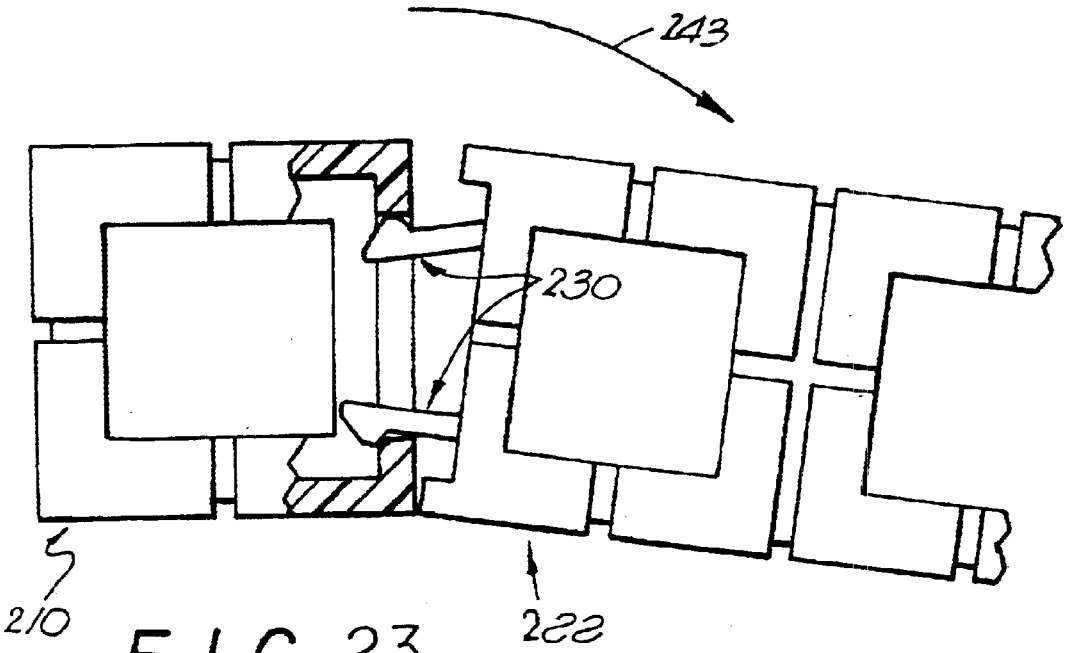
FIG. 23 is a view similar to that shown in FIGS. 21 and 22 and shows the beam partially removed form the block when a bending force indicated by an arrow is imposed on the beam.
Figure 24:
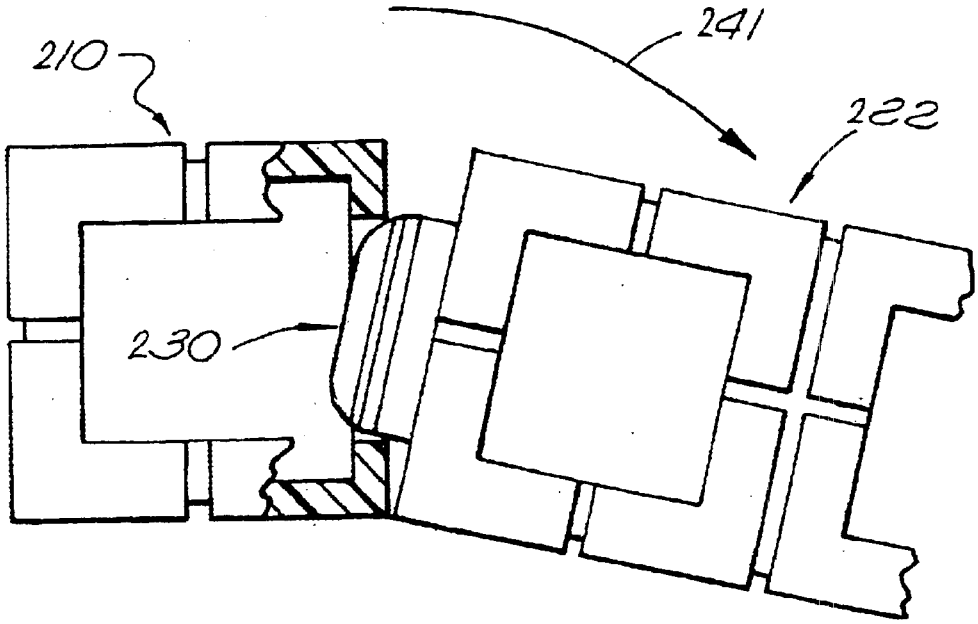
FIG. 24 is a view similar to that shown in FIGS. 21–23 and shows the beam partially removed from the block when a bending force indicated by an arrow is imposed on the beam, the bending force being displaced by an angle of substantially 90° from the bending force shown in FIG. 23.

At the positions of the detent portions 234 and 236 in each snap 230, the snap is provided with a rounded surface 239 (FIG. 20) at the opposite ends of the snap. The rounded surface 239 on each snap 230 provides for the removal of each snap from the opening 214 in the face 212 of the block 210 by bending the snap from the opening. This may be seen from FIG. 24 where the snaps 230 on one of the beams 222 have been partially bent out of the opening 214. The direction of such bending is indicated by an arrow 241 in FIG. 24. As will be appreciated, the detent portions 234 also facilitate the bending action to remove the snaps 230 from the opening 214. This bending is indicated by an arrow 243 in FIG. 23. This bending is in a direction perpendicular to the bending shown in FIG. 24. This may be seen from FIG. 23 which shows the snap 230 partially removed from the opening 214 in the block 210 as a result of the bending of the beam 222 in the direction 243.

It should be appreciated that the beam 222 does not have to be coupled to one of the openings 214 in the block 210. The beam 222 can also be coupled to one of the openings 228 in another one of the beams 222. However, the coupling of two (2) beams can occur in only one of four (4) different directions because the snaps 230 are disposed on the beams in the other two (2) directions. However, the coupling of one of the beams 222 and one of the blocks 210 can occur in any of six (6) different directions. It will thus be seen that a coupling of one of the beams 222 to one of the blocks 210 is preferable to a coupling of two (2) beams.

Figure 25:
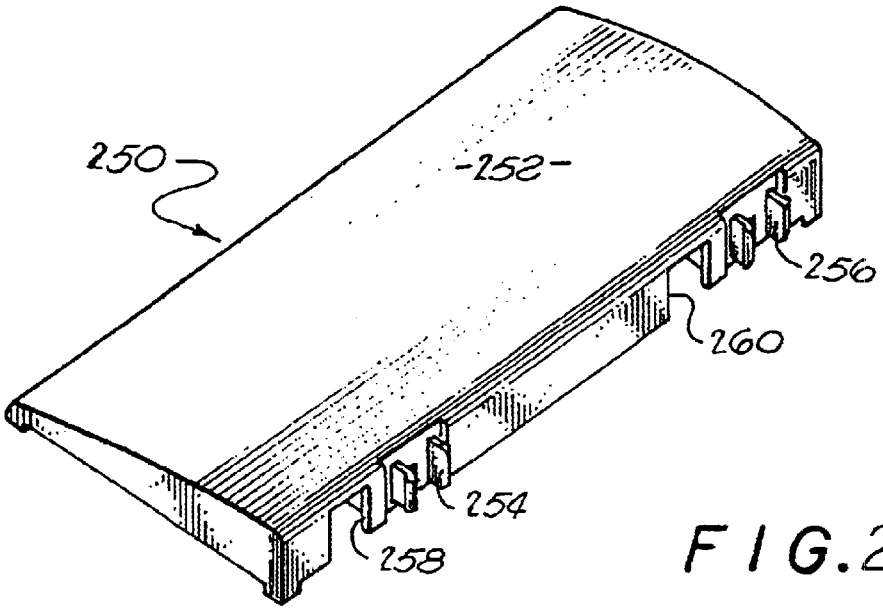
FIG. 25 is a perspective view of a member which incorporates the features of this invention and which has utility as a ramp, an awning or a roof.

FIG. 25 shows a miniramp generally indicated at 250. As will be seen, the miniramp 250 has an inclined surface 252 and has a pair of snaps 254 near one lateral end of the miniramp 250 and has a pair of snaps 256 near the other lateral end of the miniramp. The snaps 254 and 256 correspond in construction to the snaps 230. The snaps in each pair have the same spacing as the snaps 230 on one of the end faces 226 in the beam 222.

An opening 258 corresponding in construction and dimensions to the opening 214 in the block 210 is provided between the snaps 254 and the adjacent lateral extremity of the miniramp 250. In like manner, an opening 260 is provided between the snaps 254 and 256 but adjacent to the snaps 256. Two of the miniramps 250 can be illustratively coupled to each other to form a roof by disposing the snaps 254 in a first one of the miniramps in the opening 260 in the other miniramp and by disposing the snaps 256 in the other miniramp in the opening 258 in the first one of the miniramps.

Figure 27:
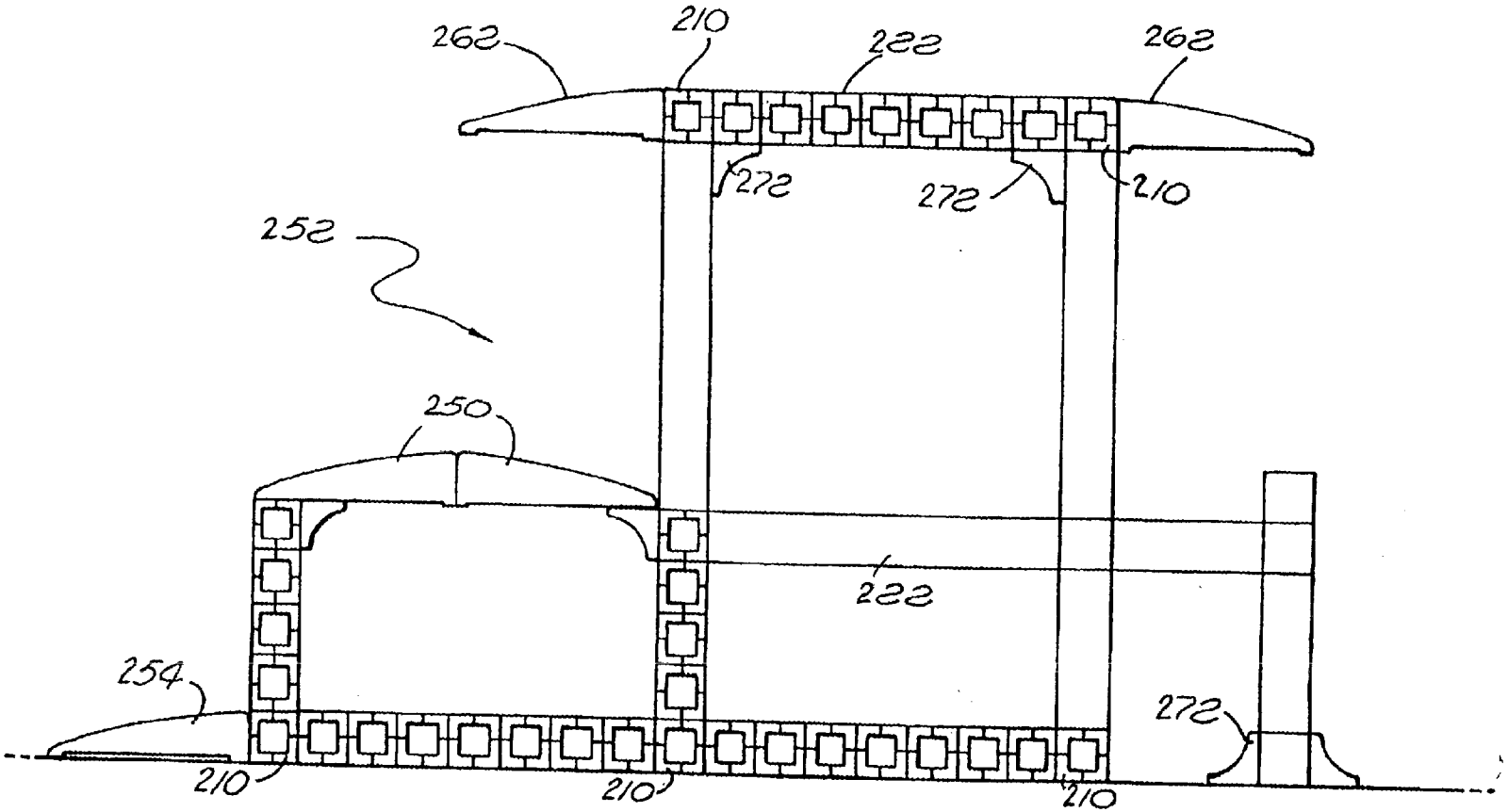
FIG. 27 is a perspective view of a simple structure which can be formed from the blocks, the beams, a pair of the roofs, a ramp and several corbels, all of which are shown in the FIGS. 16–27.
Figure 28:
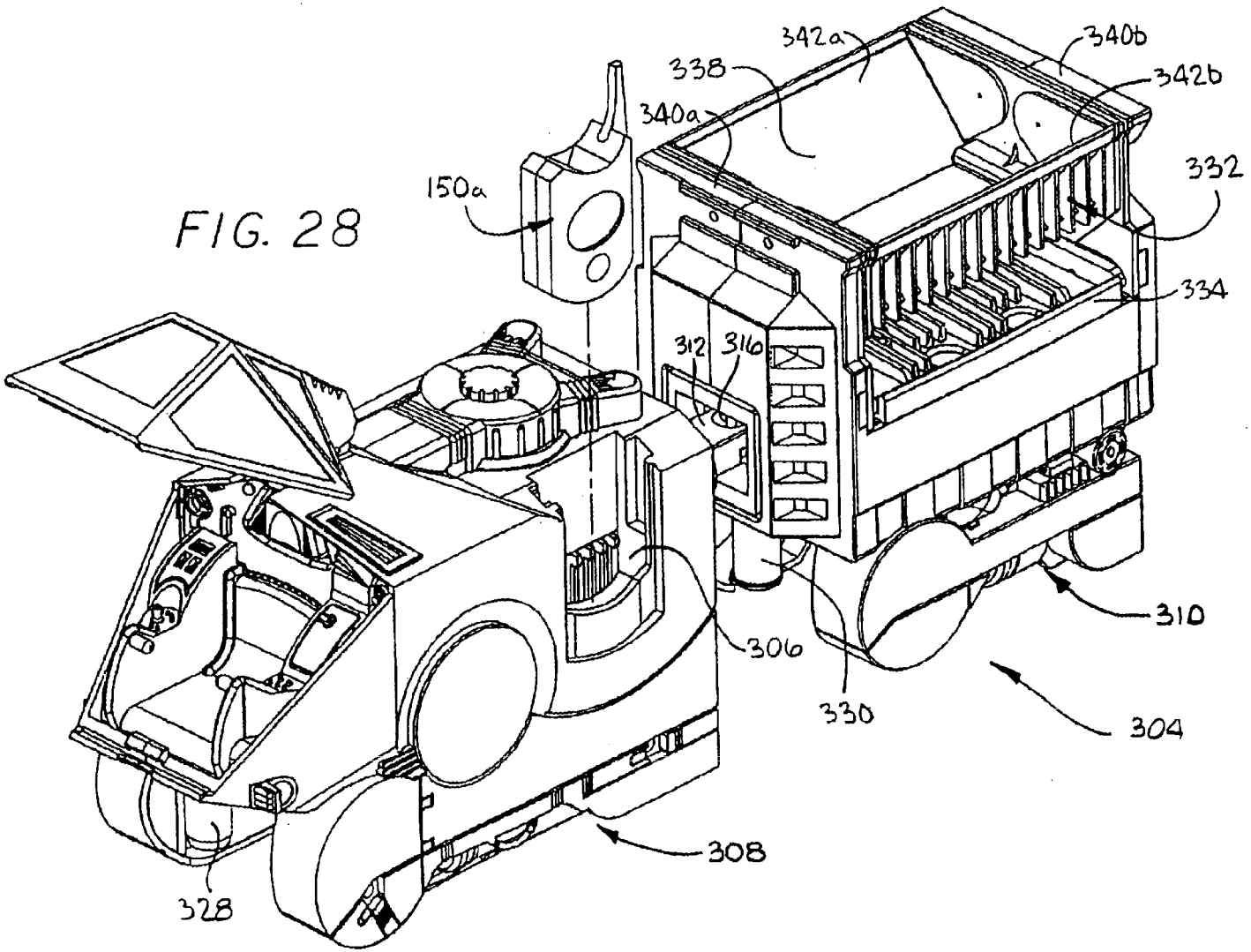
FIG. 28 constitutes a perspective view of a vehicle (e.g. a monorail) which is movable in selective ones of two (2) opposite directions on a track.
Figure 29A:
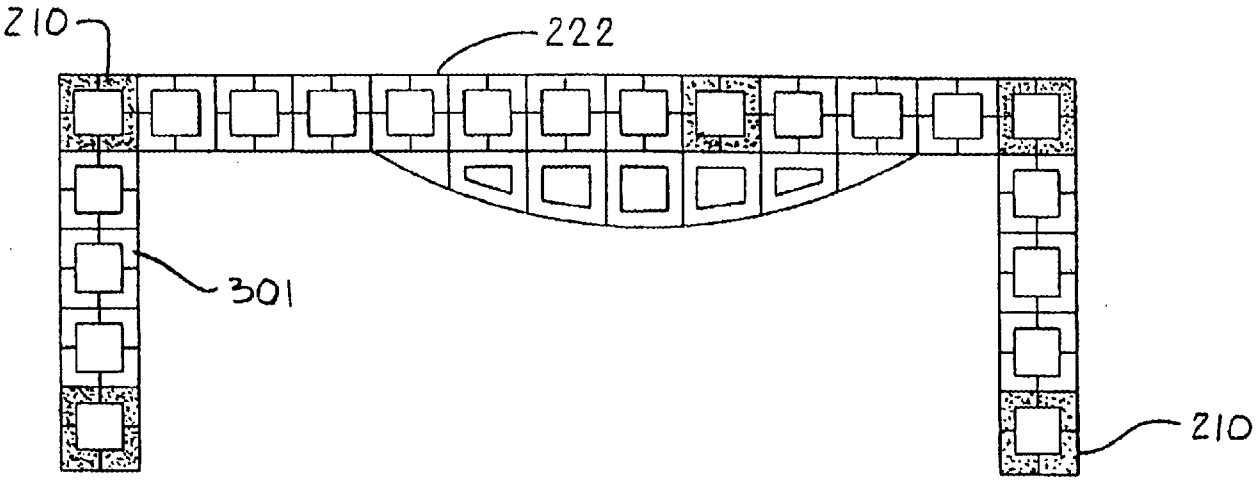
FIG. 29*a* is an elevational view of one embodiment of a vehicular track, and of supports extending from a support surface to the vehicular track, to dispose the track at a position raised from the support for receiving the vehicle shown in FIG. 28, the track and the supports being made from the beams and blocks shown in FIGS. 16–27.
Figure 29B:
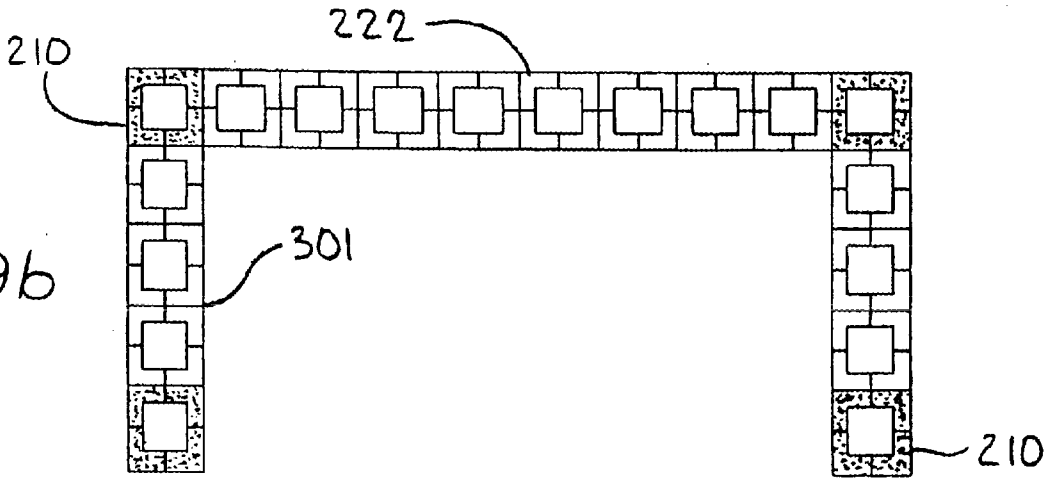
FIG. 29*b* is an elevational view of another embodiment of a vehicular track and supports made from the beams and blocks shown in FIGS. 16–27.

As shown in FIG. 27, the miniramp 250 may be coupled to a structure, generally indicated at 252, formed from a plurality of the blocks 210 and a plurality of the beams 222 so as to define a ramp 254 leading into the structure. When children are engaged im creative play, vehicles may be moved along the ramp 254 by the children into and out of the structure. Alternatively, as shown in FIG. 27, two (2) miniramps 250 may be used as roof overhangs 262 for the structure 252 in addition to the use of an additional one of the miniramps as the ramp 254. The snaps 230 from one of the beams 222 may be inserted into the miniramp 250 when the miniramp is used as the roof overhang 262.

Figure 26:
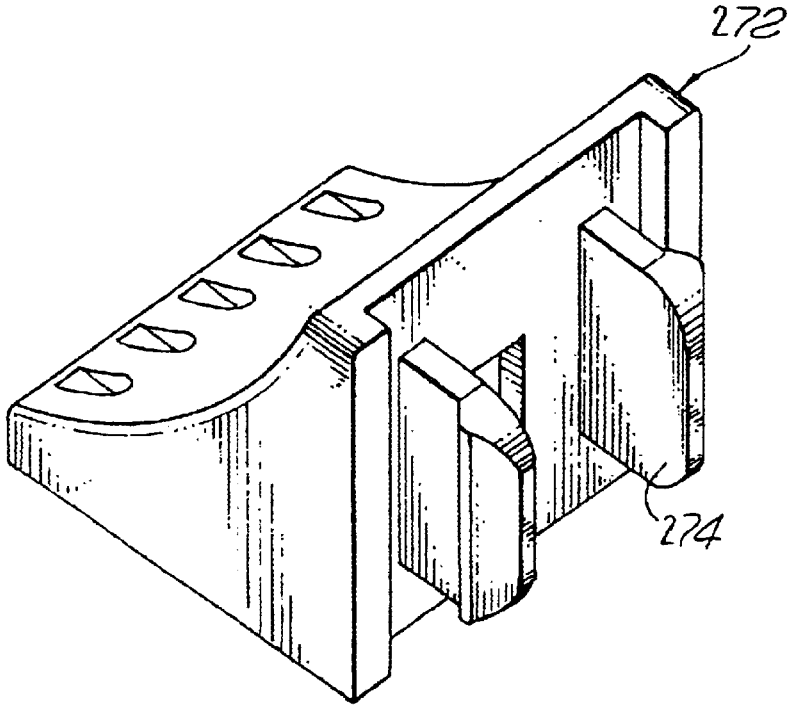
FIG. 26 is a perspective view of another member which incorporates the features of this invention and which constitutes a corbel.

The structure 252 shown in FIG. 27 includes a plurality of corbels. One of the corbels is shown in FIG. 26 and is generally indicated at 272. Each of the corbels 272 is disposed to provide support to the structure 252 in FIG. 27. Each of the corbels 272 includes a pair of snaps 274 having the same construction and disposition relative to each other as the snaps 230 in the beam 222. As will be seen, the snaps 274 are disposed in one of the openings 228 in one of the blocks 210.

The blocks 210 and the beams 222 have certain important advantages when used in a cooperative relationship. The blocks 210 preferably have six (6) identical faces 212 and preferably have identical openings 214 in the different faces. Because of this, all of the faces 212 in the block 210 are female. The beams 222 can be considered as being partially female and partially male. The male members in the beam 222 constitute the snaps 230.

The snaps 230 can be disposed in any of the openings 214 in the blocks 212 without interfering with the snaps in any of the other openings in such blocks. When the snaps 230 from different ones of the beams 222 are in all of the six (6) openings 214 in the block 210, the beams 222 including the snaps extend outwardly from the block 210 in six (6) different directions. This provides for the extension of the structure, such as the structure 252, in six (6) different directions. The snaps 230 in the beams 222 can also be disposed in the openings 228 in others of the beams 222.

When the snaps 230 in one of the beams 222 have been inserted into the opening 214 in the block 210, they can be removed from the openings by pulling (FIG. 22) the snaps out of the openings or by bending (FIGS. 23 and 24) the snaps from the openings in either of two (2) different rotary directions displaced by 90° from each other. This provides for a relatively simple coupling and decoupling of the blocks 210 and the beams 222.

The blocks 210 and the beams 222 have a uniform disposition on a support surface such as a platform or a floor. This simplifies the ability of children to form creative structures from the blocks 210 and the beams 222. It also facilitates the ability to stack the blocks 210 and the beams 222 compactly in an enclosure such as a box when the blocks and the beams are not being used.

As will be seen, each of the vehicles 12, 14, 16 and 17 is addressable with an individual address dependent upon the insertion of an individual one of the keys 150*a*–150*h* in the socket 154 in the vehicle. When addressed, each of the vehicles 12, 14, 16 and 17 is movable on support structure, generally indicated at 301 in FIGS. 33–36, provided by an intercoupling between individual ones of the beams 222 and the blocks 210. This support structure 301 may have any one of an infinite number of different configurations. This structure may be formed so that each of the vehicles 12, 14, 16 and 17 may be movable in any direction on the structure. This structure may be disposed on a platform or a floor and the addressed vehicles 12, 14, 16 and 17 may also be movable on the platform or floor between different portions of the support structure.

Figures 30, 32:
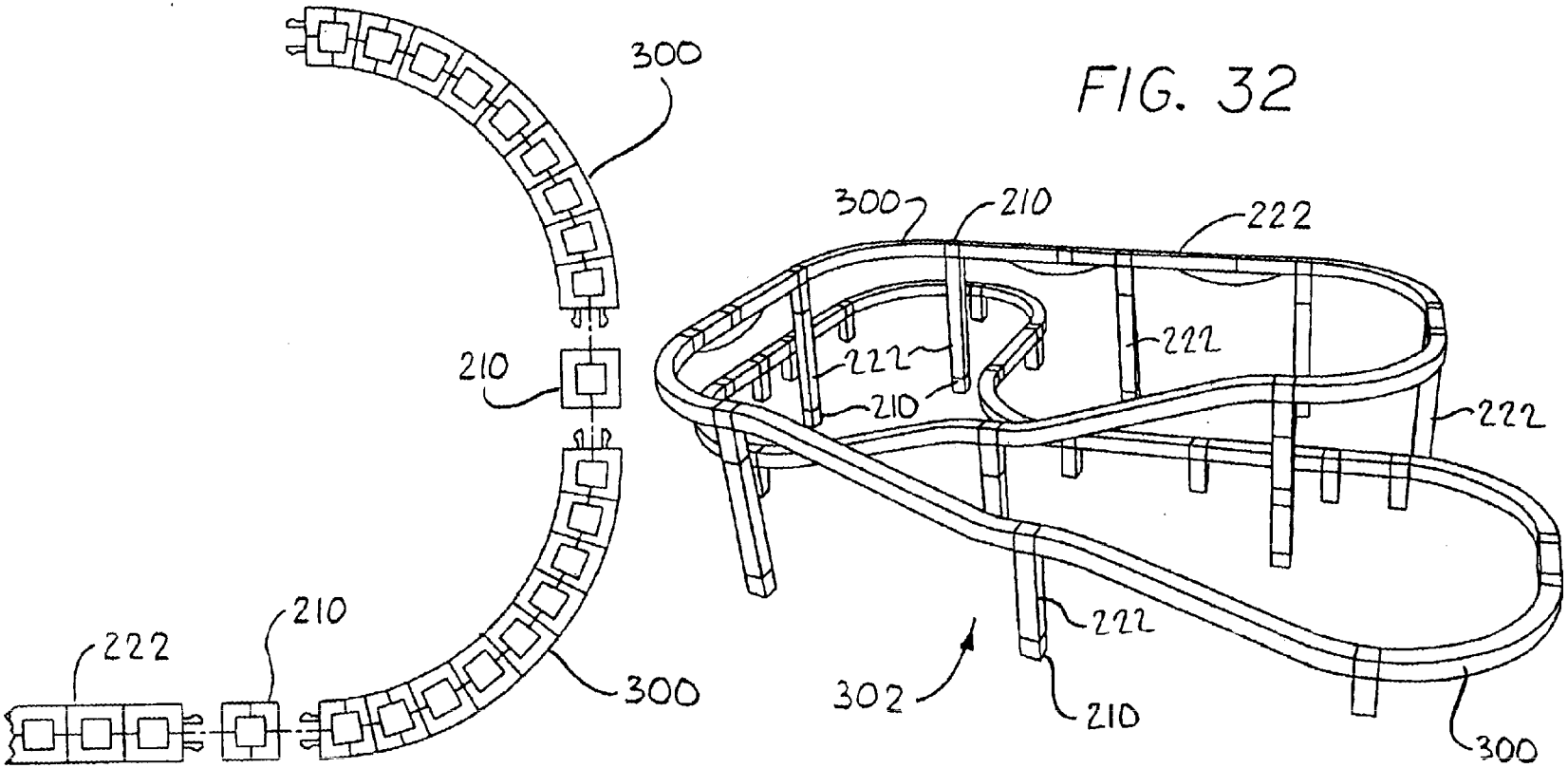
FIG. 30 is a fragmentary plan view of a vehicular track formed from the beam and blocks shown in FIGS. 16–27 and including beams with curved configurations.
FIG. 32 is a schematic perspective view of a vehicular track for receiving the vehicle shown in FIG. 28, the vehicular track being disposed in a closed loop formed from a plurality of interconnected segments extending in different directions.
Figure 35:
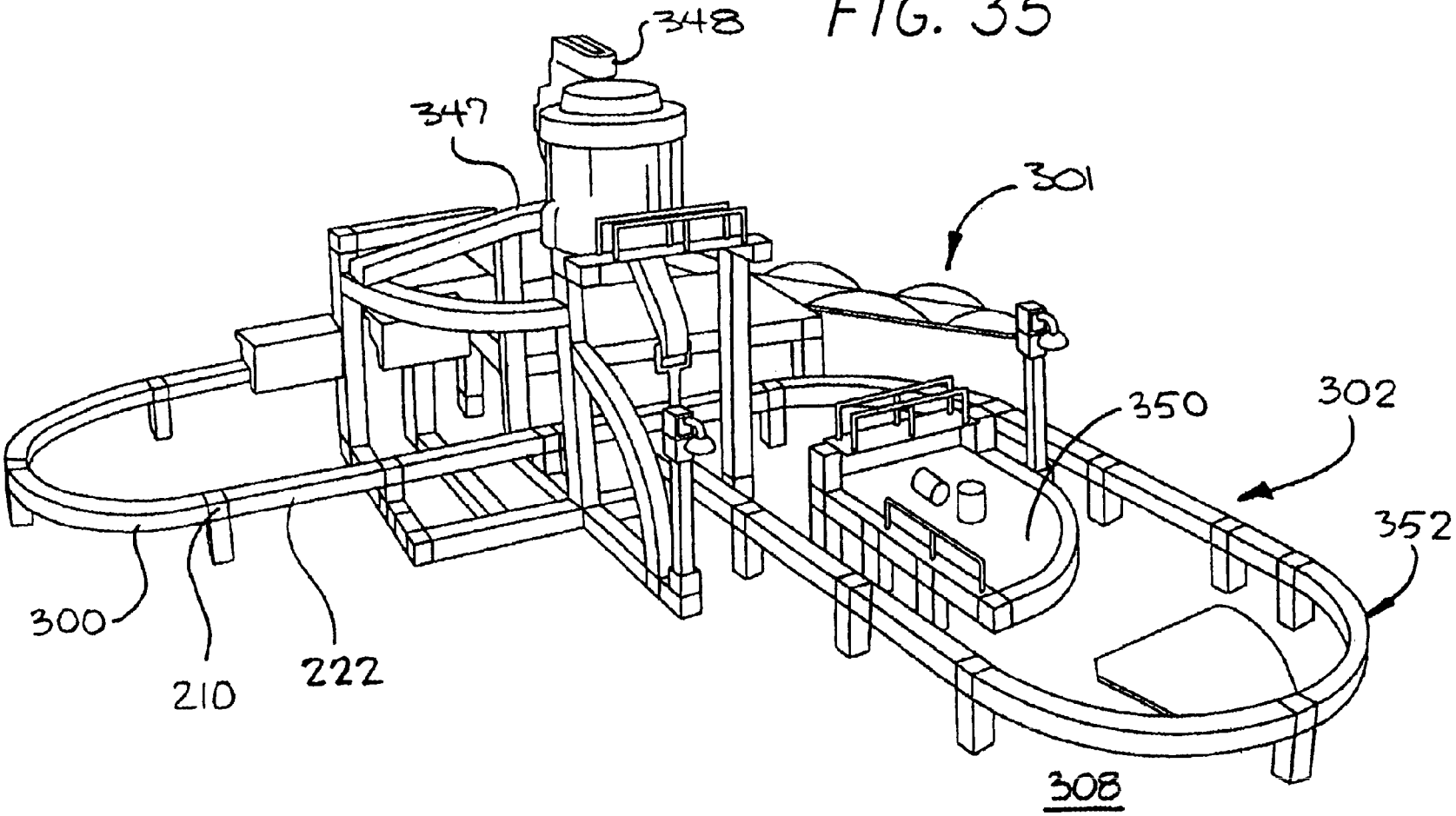
FIG. 35 is a schematic perspective view of another form of support structure for the vehicles shown in FIG. 1 and then form of the track for the monorail shown in FIGS. 28 and 31 and the conveyor shown in FIGS. 33 and 34.

It will be appreciated that the beams 222 may be provided with curved configurations rather than the straight configurations shown in FIGS. 16–24. For example, a beam 300 with a curved configuration is shown in FIG. 30. The beams 222 with straight configurations and the beams 300 with the curved configurations may be interconnected with individual ones of the blocks 210 to form a track 302. The track 302 may be disposed in a closed loop as illustrated in FIG. 32 or it may be disposed in an open loop as shown in FIG. 35. Different embodiments of the track 302 are shown in FIGS. 32 through 36.

A vehicle generally indicated at 304 (FIGS. 31, 33–34 and 37–38) is movable in forward and rearward directions on the track 302. The vehicle may constitute a monorail. The vehicle 304 is provided with a socket 306 (corresponding to the socket 154 in the vehicles 12, 14, 16 and 17) for receiving any one of the keys 150*a*–150*h* in a manner similar to that described above for the vehicles 12, 14, 16 and 17. Thus, a person operating any one of the pads 42*a*–42*d* can address the vehicle 304 while other individuals operating other ones of the pads 42*a*–42*d* can address any one of the vehicles 12, 14, 16 and 17 not addressed at that time.

Figure 33:
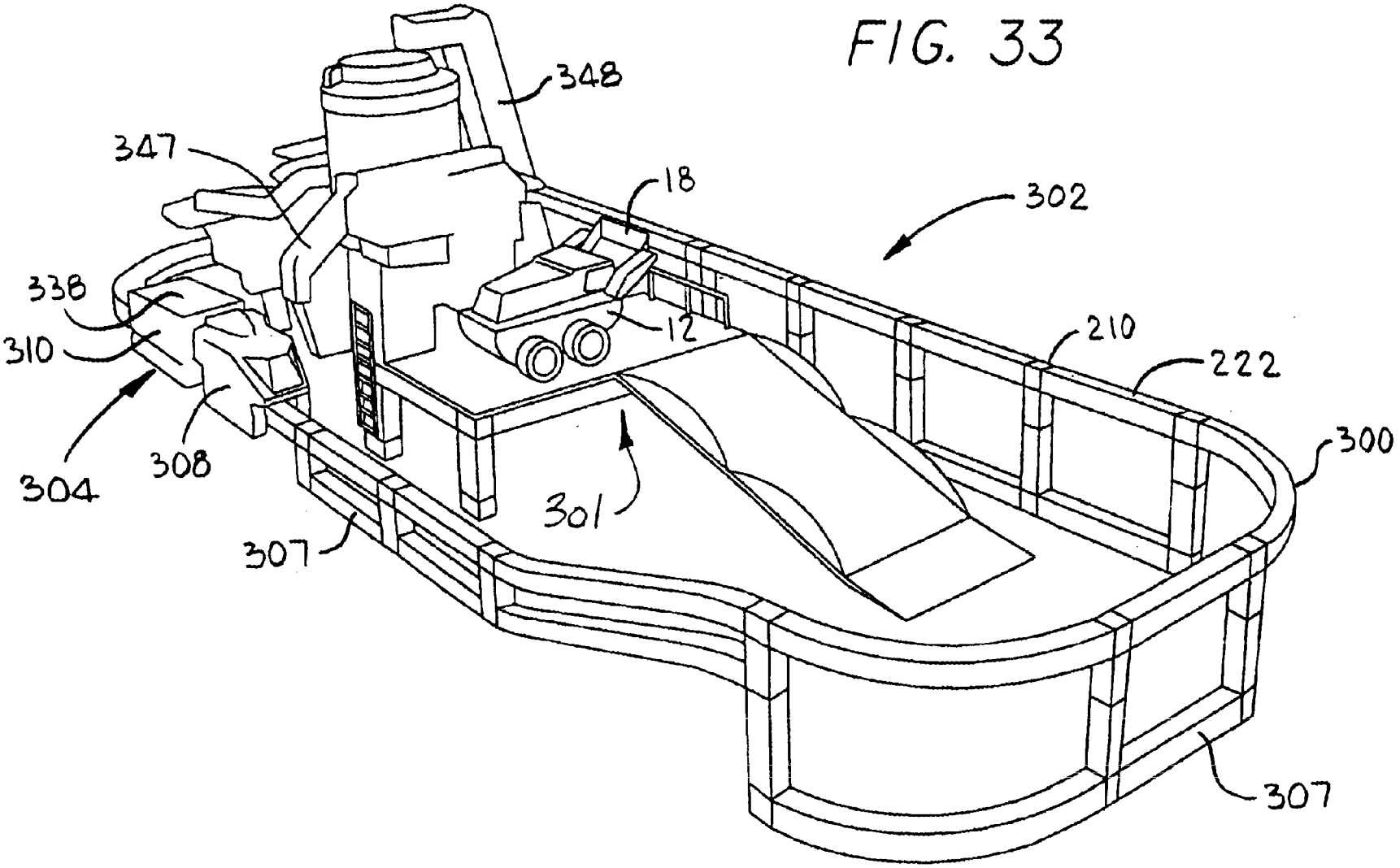
FIG. 33 is a schematic perspective view of support structure for a movement of vehicles (e.g.
Figures 34, 36:
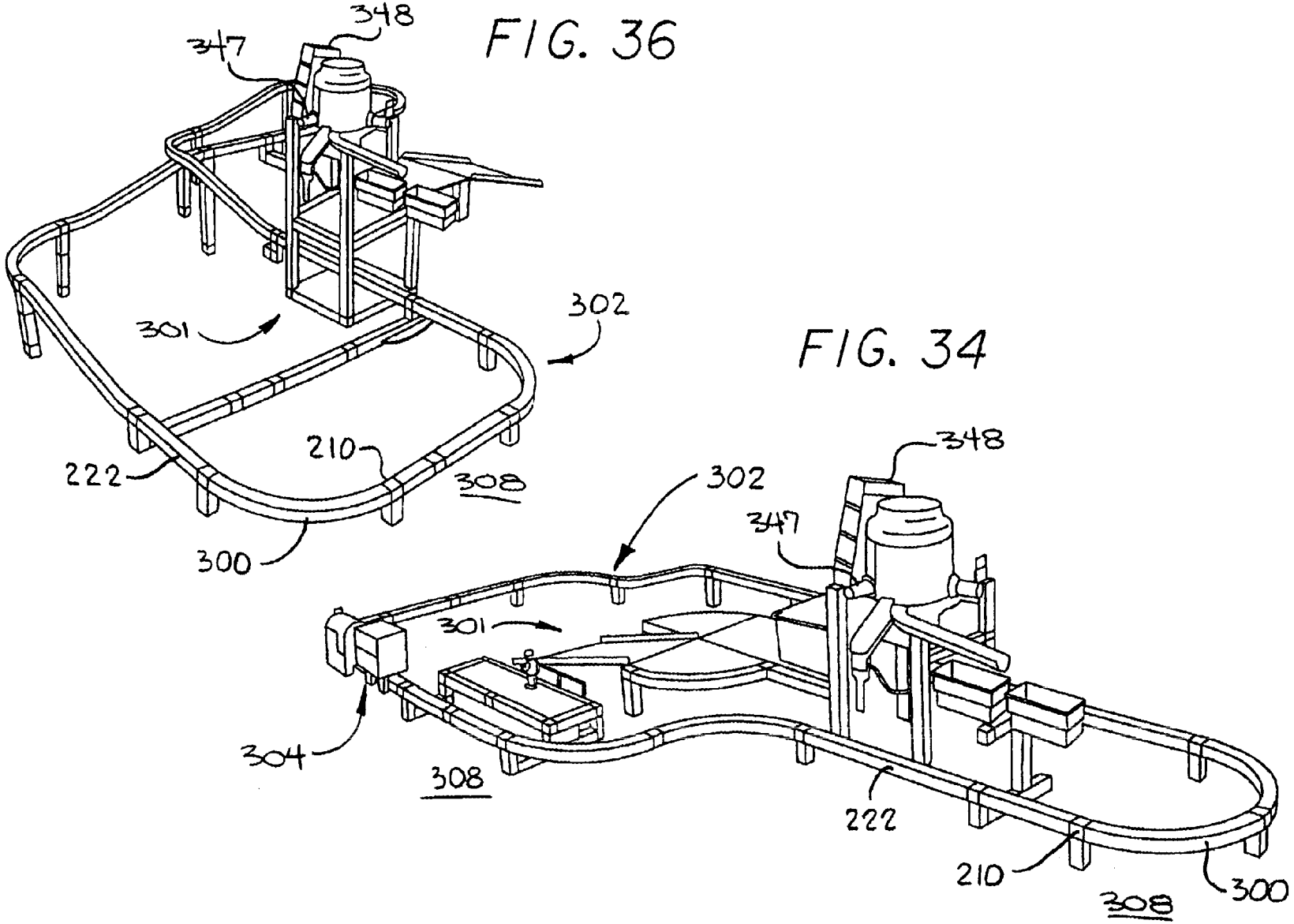
FIG. 34 is a schematic perspective view of support structure for the vehicles shown in FIG. 11 and of a track for the monorail shown in FIGS. 28 and 31 and additionally shows the conveyor also shown in FIG. 33.
FIG. 36 is a schematic perspective view of still another form of support structure for the vehicles shown in FIG. 1 and another form of the track for the monorail shown in FIGS. 28 and 31 and the conveyor shown in FIGS. 33 and 34.

The track 302 can be physically intercoupled with the support structure 301 so as to support, stabilize or rigidify the support structure 301 (FIG. 33). This intercoupling can be provided by individual ones of the beams 222 (and/or the beams 300) and the blocks 210 intercoupled between the support structure 301 and the track 302. Alternatively, the track 302 can be physically intercoupled with the support structure 301 so as to support, stabilize or rigidify the support structure 301 (FIG. 36). This intercoupling can also be provided by individual ones of the beams 222 (and/or the beams 300) and the blocks 210. As another alternative, the support structure 301 and the track 302 can be physically intercoupled without either of the support structure 301 or the track 302 supporting the other one of the support structure 301 or the track 302. It will be appreciated that, without departing from the scope of the invention, there does not have to be any physical intercoupling between the support structure 301 and the track 302 FIG. 35). The support structure 201 and the track 302 may be disposed on a platform 307 or a floor 308.

Figure 31:
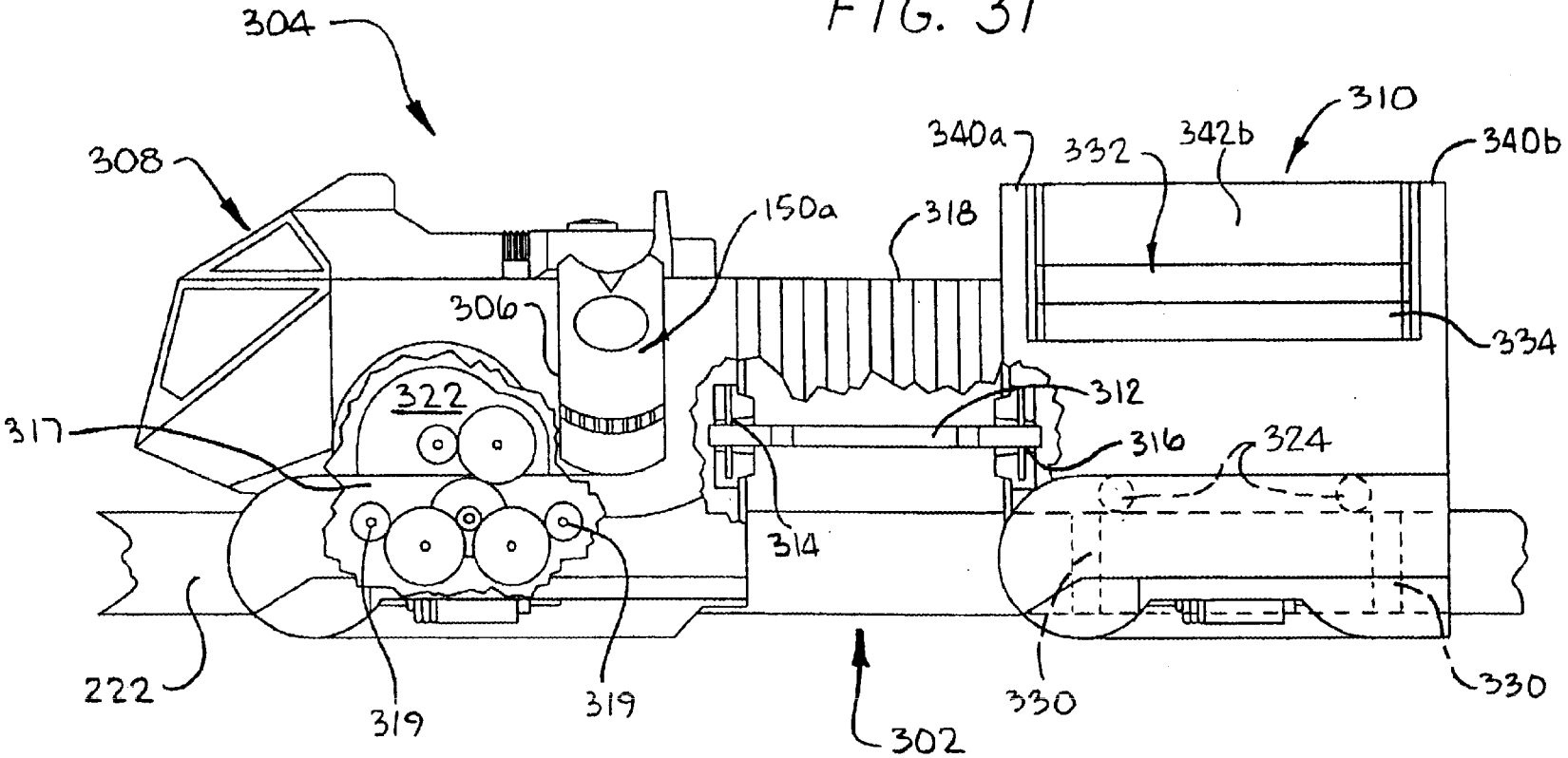
FIG. 31 is an elevational view, partially broken away, of the vehicle (e.g. monorail) shown in FIG. 28.
Figure 38:
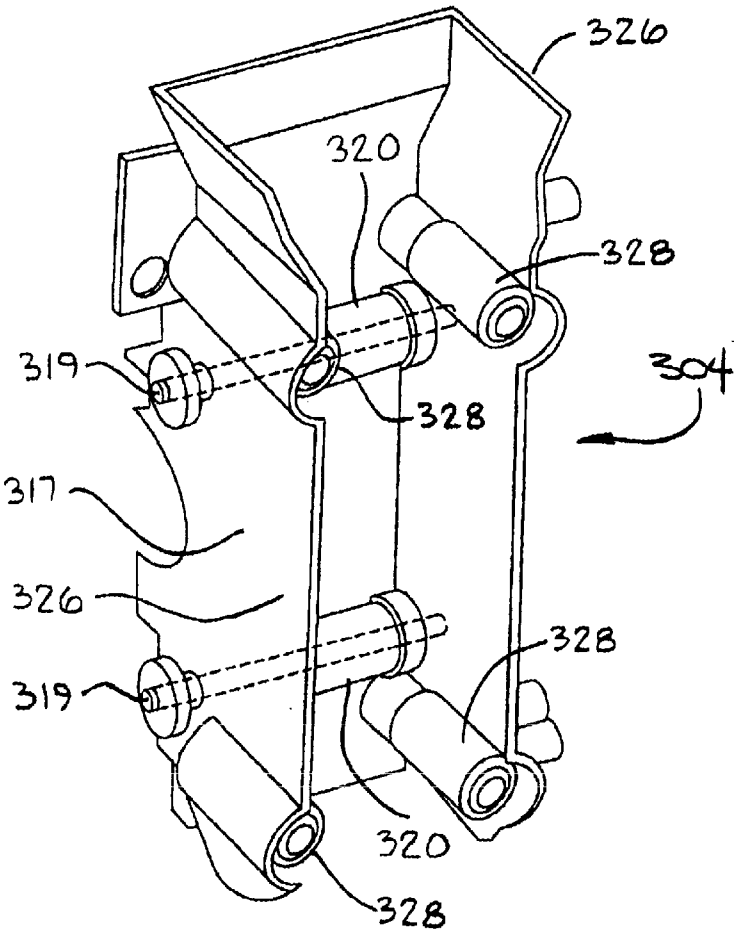
FIG. 38 is a schematic perspective view of the monorail as seen from a position below the vehicle and shows the arrangement for driving the monorail on the track and for retaining the monorail on the track during the movement of the monorail on the track.
Figure 37:
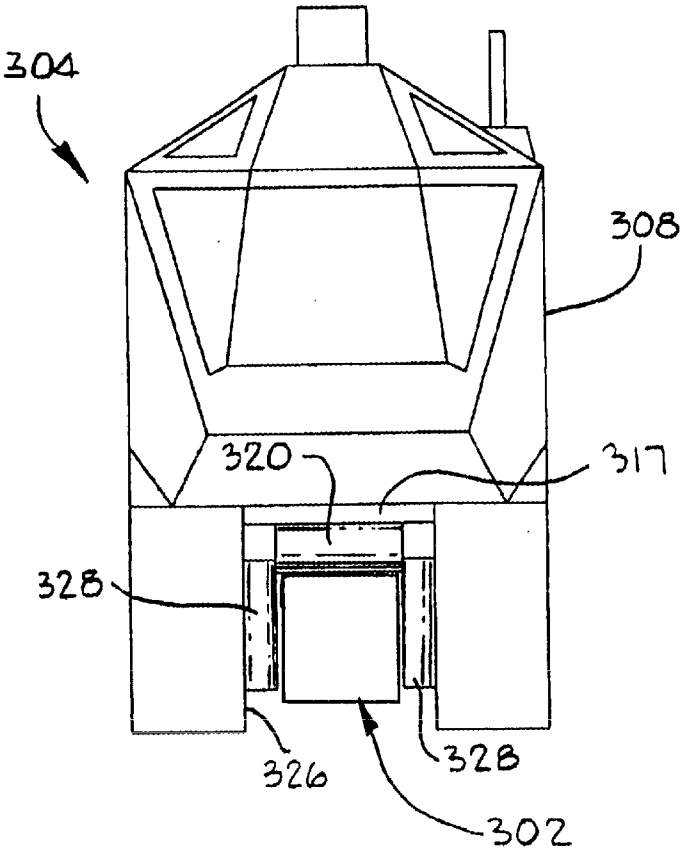
FIG. 37 is a schematic elevational view of the track and the monorail on the track and shows how the vehicle is retained on the track during the movement of the monorail on the track.

The vehicle 304 may be formed from an engine 308 (FIGS. 31, 37 and 38) and a caboose 310 (FIG. 31). The engine 308 and the caboose 310 may be movable on a unitary basis by providing a coupling member 312 between the engine and the caboose. The coupling member 312 may be pivotably coupled to the engine as at 314 and may be fixedly coupled to the caboose 310 as at 316. The vehicle is separated into the engine 308 and the caboose 310, rather than being formed as a unitary structure, to facilitate the movement of the vehicle on the track 302 through the curved portions of the track without falling from the track. A shroud 318 may cover the coupling member 312 to provide the vehicle 304 with the appearance of a unitary structure. The vehicle 304 includes a chassis 317 (FIGS. 31, 37 and 38)

disposed on the engine 308 and having a pair of spaced side surfaces and a pair of axles 319 disposed on the chassis in a spaced relationship in a longitudinal direction.

The engine 308 may be provided with a pair of longitudinally spaced rollers 320 (FIGS. 37 and 38) which are disposed on the axles 319 for rotary movement or the top surface of the track 302 and which extend laterally across substantially the width of the track 302 to roll on the top surface of the track. The rollers 308 are driven by a motor 322 (FIG. 31) mounted on the chassis 317 of the engine 308. In like manner, the caboose 310 may be provided with a pair of longitudinally spaced rollers 324 which extend laterally across substantially the width of the track 302 to roll on the top surface of the track. The rollers 324 on the caboose 310 rotate in accordance with the rotation of the rollers 320 on the engine.

The engine 308 may be provided at its opposite lateral ends with skirts 326 (FIGS. 37 and 38) which extend below the top of the track 302 to a position opposite the side surfaces of the track. Guides 328 may be disposed at the inner surfaces of the skirts 326 in relatively close proximity to the lateral sides of the track 302. The guides 328 facilitate the retention of the engine 308 on the track 302 during the time that the engine is moving on the track. The guides 328 may constitute wheels supported by the skirts 326 and rotatable in the direction of movement of the vehicle 304.

It will be appreciated that the guides 328 are normally spaced from the side surfaces of the track 302 and that they engage the side surfaces of the track only occasionally as the engine 308 moves along the track. The guides 328 may be made from a suitable material such as Teflon or ABS plastic which provides a low friction when the guides engage the side surface of the track. The guides 328 may be shaped to provide a contact with the side surfaces of the track in a minimal area of the guides. Guides 330 corresponding to the guides 328 may also be disposed on skirts extending on the caboose 310 along the side surfaces of the track 302.

The caboose 310 includes apparatus, generally indicated at 332 (FIGS. 31, 39 and 40), for performing functions other than the movement of the vehicle 304 on the track 302. Some of these functions are shown in the vehicles 12, 14, 16 and 17 in FIG. 1. For example, the apparatus 332 may include a laterally movable bed 334 (FIGS. 39 and 40) disposed on the upper surface of the caboose 310. The bed 334 is movable laterally in a selective one of two (2) opposite directions by a motor 336 operatively coupled to the bed.

A bin or receptacle generally indicated at 338 (FIGS. 39 and 40) is disposed on the bed 334. The bin or receptacle 338 may be rectangular in horizontal section. The bin or receptacle 338 includes a pair of oppositely disposed fixed walls 340*a* (FIG. 31) and 340*b* (FIGS. 31, 39 and 40) and a pair of oppositely disposed pivotable wall plates 342*a* and 342*b* (FIGS. 39 and 40) which are respectively disposed on pivotable pins 344*a* and 344*b* to provide for a pivotable movement of the wall plates with the pivotable movement of the pins. The opposite ends of a helical spring 346 are respectively coupled to the wall plates 342*a* and 344*b*. The helical spring 346 provides for the return of the pivotable wall plates 342*a* and 342*b* to their at rest positions when the pivotable force on the wall plates is removed.

A conveyor 348 (FIGS. 33–36) and a chute 347 extending downwardly from the top of the conveyor may be disposed on one side of the track 302. When the vehicle 304 is moved on the track 302 to a position such that the bin or receptacle 338 is disposed below the upper end of the chute 347, with the bed 334 in one (1) of two (2) lateral positions. The wall 342*a* may be pivoted downwardly. This provides for the introduction to the bin or receptacle 338 on the caboose 310 of play elements (such as slotted marbles) movable upwardly along the conveyor 348 to the top of the conveyor and then movable downwardly through the chute 347 to a position above the bin or receptacle in the vehicle 304. When the bed 334 is in the other of the two (2) lateral positions, the bed 334 may have to be moved laterally to the one (1) lateral position to position the bin or receptacle 338 below the chute 337.

One of the vehicles (e.g., the vehicle 12) may be disposed on the side of the track 302 opposite the conveyor 348 and the chute 347. When the vehicle 304 is thereafter moved to a position above the vehicle 12, the bed 334 may be moved laterally by the motor 336 to the side of the track where the vehicle 12 is located. The wall 342*b* may then be pivoted to provide for the transfer of the play elements (e.g., marbles) from the bin or receptacle 338 to the bin or container 18 in the dump truck 12. The bin or container 18 in the dump truck 12 is able to receive the play elements from the vehicle 304 because the vehicle 12 moves on the support structure 301 on the floor 308 to the track 302 which is raised relative to the support structure or floor so that the bin or receptacle on the vehicle 304 is above the bin or container 18 on the vehicle 12. The skip loaders 16 and 17 also have bins or containers which are able to receive the play elements (e.g. marbles) in the bin or receptacle 338 on the vehicle 304.

Figure 39:
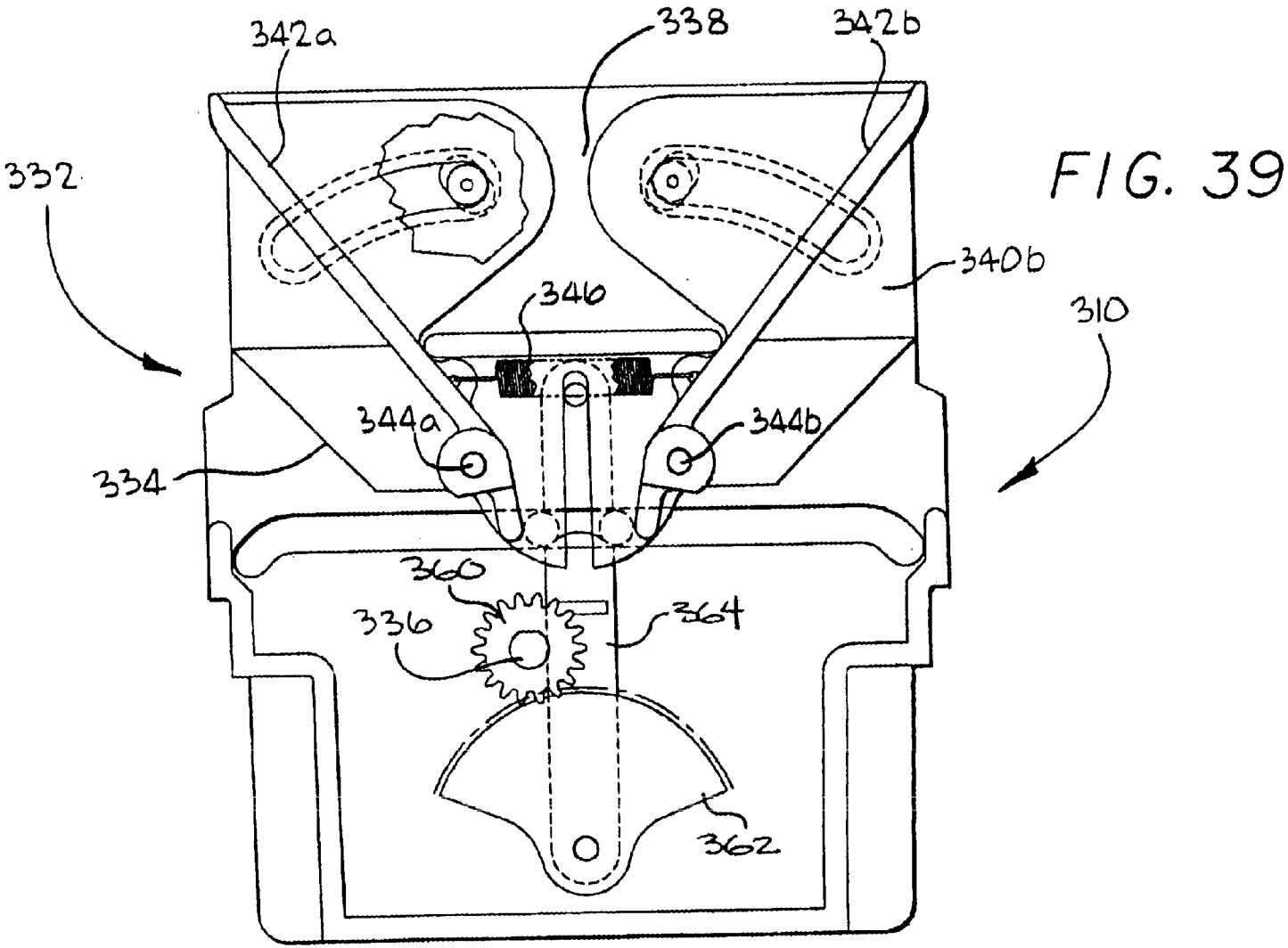
FIG. 39 is an elevational view of the monorail including a bin or acceptable for receiving play elements (e.g. marbles) as from the conveyor shown in FIGS. 33–36 and for transferring the play elements to bins or containers in the vehicles shown in FIG. 11.
Figure 40:
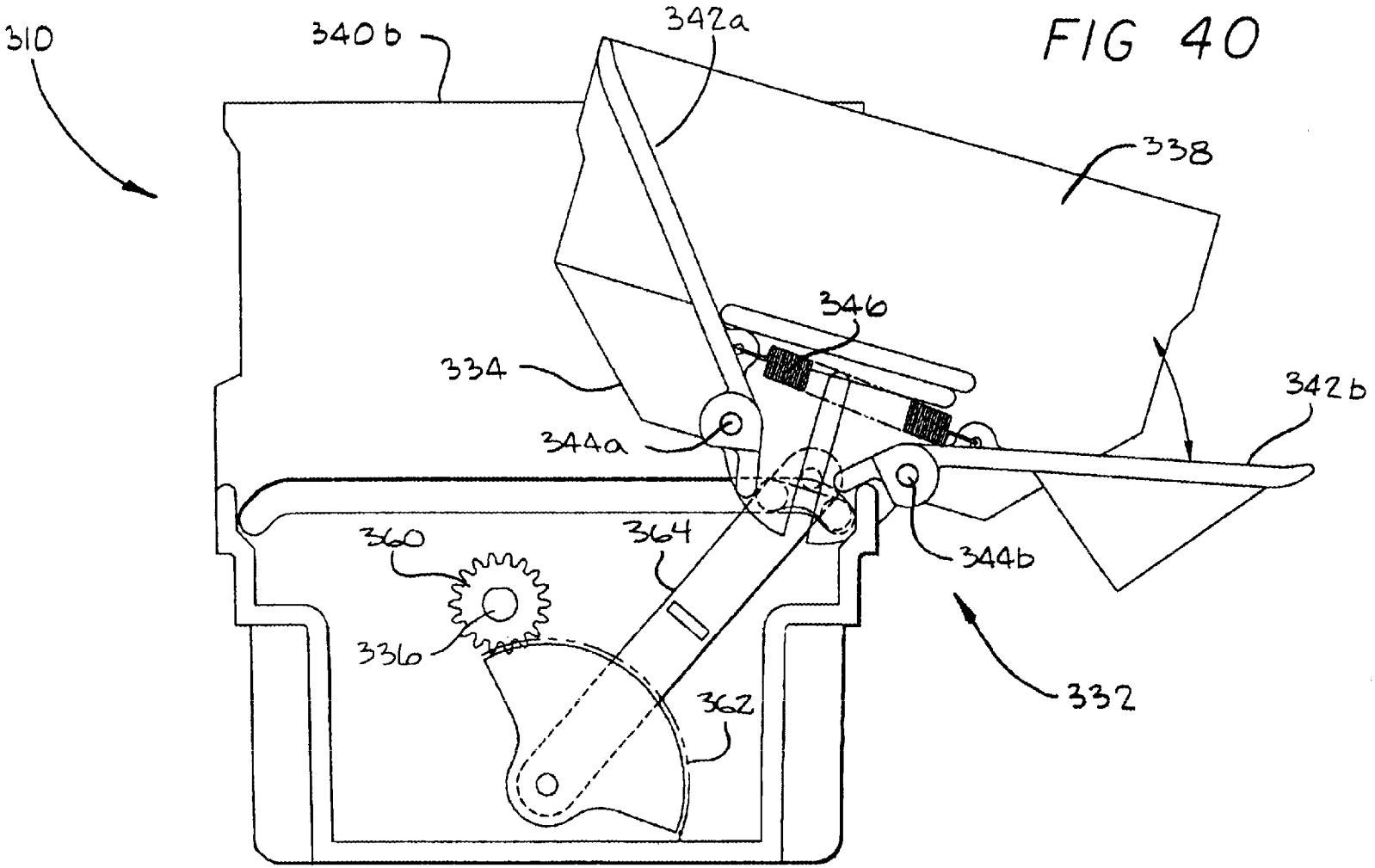
FIG. 40 is an elevational view of the monorail including the bin or receptacle for transferring the play elements (e.g. marbles) in the monorail to the bin or container in one of the vehicles shown in FIG. 1.

To move the bin or receptacle 338 from the position shown in FIG. 39 to the position shown in FIG. 40, the motor 336 drives a pinion gear 350 which in turn drives a sector gear 352 in a clockwise rotation. The sector gear drives an arm 354 in a direction which causes the bin or receptacle 338 to pivot downwardly (clockwise). This in turn causes the wall plate 342*b* to extend outwardly below a horizontal plan as shown in FIG. 40. As a result, the play elements (e.g. marbles) roll downwardly into the bin or container 18 on the vehicle 12. When the bin or receptacle 338 tilts downwardly as shown in FIG. 40, it causes the helical spring 346 to become constrained in a direction to facilitate the return of the bin or receptacle to the position shown in FIG. 39.

FIG. 32 shows one version of the track 302. As will be seen, the beams 222 and the block 210 are disposed vertically at spaced positions along the track 302 to support a different portion of the track at different vertical levels. Furthermore, the version of the track 302 in FIG. 32 constitutes a complex structure in which the track extends through a number of turns in different directions and in which the track defines a closed loop where the starting and ending positions are the same.

FIG. 35 shows a deck plate 350 disposed within a curved portion 352 of another version of the track 302. The deck plate 350 is connected to the track 302 to enhance the stability and rigidity of the track and the support structure 301. This is different from the previous embodiments since the deck plate may not be considered as a part of the support structure 301 on which the vehicles 12, 14, 16 and 17 are movable. Furthermore, as will be seen, the track 302 is not disposed in a closed loop.

FIG. 34 also shows another version of the support structure 301 on which the vehicles 12, 14, 16 and 17 are movable. The version of the support structure 301 in FIG. 35 is intercoupled with the version of the track 302 in FIG. 34 to enhance the stability and rigidity of the track. FIG. 34 also shows a deck plate 354 on which the vehicles 12, 14, 16 and 17 are movable.

FIG. 36 also shows still another version of the support structure 301 on which the vehicles 12, 14, 16 and 17 are movable. The version of the support structure 301 in FIG. 36 is also intercoupled with the version of the track 302 in FIG. 36 to enhance the stability and rigidity of the track and the support structure Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the appended claims.

What is claimed is:

1. In combination, a first vehicle having first members to provide a movement of the vehicle and having first controls operable on the first members to provide for a movement of the vehicle and having a second member for performing functions other than the movement of the vehicle and having second controls operable on the second member to obtain the performance of the functions by the second member, a support structure defining a path for the movement of the first vehicle, a plurality of pads each having a plurality of switches controlling the addressing of the first vehicle and additional vehicles and controlling the operation of the first and second controls in the first vehicle, and a central station responsive to the operation of the switches in the pads for providing for an operation of the first and second controls in the first vehicle when the first vehicle is addressed by any one of the pads.

2. In a combination as set forth in claim 1 wherein the support structure defines a track and wherein the first vehicle is constructed to move on the track.

3. In a combination as set forth in claim 2 wherein the support structure is defined by beams and blocks having particular constructions to provide interconnections between the beams and blocks and wherein the support structure defines a track produced from the beams and blocks having the particular constructions to provide interconnections between the beams and blocks in the track and wherein the first vehicle rides on the track and wherein the track produced from the interconnected beams and blocks in the support structure has characteristics for retaining the vehicle on the track.

4. In a combination as recited in claim 1 wherein the support structure is manually assembled from beams and blocks interconnected with one another and having an identical construction of the beams and an identical construction of the blocks and wherein the first vehicle constitutes a monorail and the interconnected beams and blocks in the structure define the track for the monorail.

5. In a combination as set forth in claim 4 wherein the interconnected beams in the support structure include detents providing for the interconnections of the beams and the blocks in the support structure.

6. In combination, a first vehicle constructed to move only in first and second opposite directions and having first controls for providing a movement of the first vehicle in the first and second opposite directions and having second controls for performing functions other than the movement of the first vehicle in the first and second opposite directions, a support structure providing for the movement of the first vehicle in the first and second opposite directions, a plurality of pads each having switches controlling the addressing of any one of the first vehicle in the plurality and additional vehicles and controlling the movement of the first vehicle, when addressed, in the first and second opposite directions and controlling the operation of the second controls in the first vehicle, when addressed, in performing the functions in the first vehicle, and a central station responsive to the operations of the switches in each of the pads for addressing any one of the first vehicle and the additional vehicles not addressed by any of the other pads and for providing for movements of the first vehicle, when addressed, in accordance with the operation of the first controls in the first vehicle and for providing for the performance of the functions in the first vehicle, when addressed, in accordance with the operation of the second controls in the first vehicle.

7. In a combination as set forth in claim 6 wherein the support structure is defined by beams and blocks manually interconnected in a particular relationship and wherein the interconnection between the beams and blocks in the support structure defines a track for receiving the first vehicle and for providing for the movement of the first vehicle in the first and second opposite directions.

8. In a combination as set forth in claim 7 wherein the support structure extends from an additional support structure for the additional vehicles, and wherein the extension of the support structure from the additional support structure is defined by beams and blocks manually interconnected in the particular relationship.

9. A method of providing controlled operations, including the steps of:

providing a first vehicle having an individual address and having first controls providing for a movement of the additional vehicle when addressed and second controls providing for individual operations of the vehicle, other than movements of the vehicle, when addressed, providing a structure on which the first vehicle is able to move in a pair of opposite directions, providing a plurality of pads each having controls operable to address any one of the first vehicle and additional vehicles and to provide for a movement of the addressed vehicle and for individual operations of the addressed vehicle, operating the controls in each of the pads to address any one of the first vehicle and the additional vehicles and to provide for movements of the addressed vehicle and individual operations of the addressed vehicle, providing for a periodic activation of each of the pads to determine the addressing by the pad of any one of the first vehicle and the additional vehicles and the movement and individual operations of the addressed vehicle, providing for a sequential transmission by the pads, upon the periodic activation of the pads, of signals addressing in each of the pads any one of the first vehicle and the additional vehicles and signals indicating the movements and individual operations to be provided in the addressed vehicle, providing for the reception by the first vehicle and the additional vehicles of the signals indicating the addresses of the vehicles and the signals indicating the movements and individual operations to be provided in the addressed vehicles, and providing movements and individual operations in each of the addressed vehicles in accordance with the operation of the first and second controls in the pad addressing the vehicle.

10. A method as set forth in claim 9, including the steps of:

providing in each of the first vehicle and in the additional vehicles, a visual indication individually identifying the vehicle, providing in each of the pads indications visually identifying any individual one of the first vehicle and the additional vehicles, and activating in each of the pads the visual indication individually identifying the vehicle addressed by the pad.

11. In a method as set forth in claim 9, the steps of:

providing for the support structure beams having an identical construction, and having detents of an identical construction, and blocks having an identical construction for interconnection between adjacent beams and blocks wherein the blocks and the detents on the beams in the support structure operate in cooperation with one another and with the first vehicle to retain the first vehicle on the track.

12. In a method as set forth in claim 11 wherein the first vehicle has drive rollers rotatable on the beams and the blocks to propel the additional vehicle on the track and wherein the beams and the blocks have side surfaces and wherein the first vehicle has guides disposable relative to the side surfaces of the beams and the blocks to retain the first vehicle on the track during the movement of the first vehicle on the track.

13. A method of providing a controlled operation of a plurality of toy vehicles and an additional vehicle, including the steps of:

providing each of the toy vehicles in the plurality an address different from the addresses provided for the other toy vehicles, providing the additional toy vehicle with an address different from the addresses of the vehicles in the plurality, providing a support structure for the movement of the additional vehicle on the support structure in first and second opposite directions, providing a plurality of pads each having a first control operable to provide for an addressing of any one of the vehicles and each having second controls operable to provide for a movement, and operations other than a movement, of the addressed vehicle, providing a central station for sequentially communicating to all of the vehicles the addresses provided by the operation of the first controls in the pads in the plurality and the movement and other operations of the addressed vehicles as represented by the operations of the second controls in the pads, providing for an addressing by the central station of the vehicles in accordance with the addressing of the vehicles by the first controls in the pads, and providing in the central station for a movement and other operations of each of the addressed vehicles in accordance with the operation of the second controls in the pad addressing the vehicle.

14. A method as set forth in claim 13 wherein the central station provides for the addressing by each of the pads only of the vehicles not addressed by any of the other pads.

15. A method as set forth in claim 13 wherein the central station has a memory for indicating the vehicle being addressed by each of the pads and wherein the central station removes from the memory the addressing of each of the vehicles by the pad addressing the vehicle when the pad addressing the vehicle addresses another one of the vehicles or fails to address the vehicle within a particular period of time.

16. A method as set forth in claim 13 wherein the structure defines a loop for providing a movement of the additional vehicle only in opposite directions in the loop defined by the second support structure.

17. A method as set forth in claim 16 wherein the structure defines a single track in the loop and wherein the additional vehicle is a monorail which rides on the single track.

18. A method as set forth in claim 17 wherein the central station provides for the addressing by each of the pads only of the vehicles not addressed by any of the other pads and wherein the central station has a memory for indicating the vehicle being addressed by each of the pads and wherein the central station removes from the memory the addressing of each of the vehicles by the pad addressing the vehicle when the pad addressing the vehicle addresses another one of the vehicles or fails to address the vehicle within a particular period of time.

19. In combination, a vehicle having an individual address and movable in a selective one of two opposite directions, a structure for supporting the vehicle for movement of the vehicle in the selective one of the two opposite direction, and a pad manually operable to address the vehicle and to provide commands for moving the addressed vehicle and for performing functions other than the movement of the vehicle.

20. In a combination as set forth in claim 19, a key providing an individual address, the additional vehicle including a socket for receiving the key and for providing an address corresponding to the address provided by the key, the vehicle being constructed to be addressed by the pad when the key is in the socket.

21. In a combination as set forth in claim 20, the structure being constructed to be formed from a plurality of first elements each having first and second detents and second elements each having the second detents to provide for an intercoupling of the first detents on the first elements with the second detents on the second elements, the vehicle including a motor and rollers driven by the motor for rotation on the track, the first and second elements having side surfaces defining the width of the track, the vehicle including guides disposed relative to the side surfaces of the track for maintaining the vehicle on the track during the movement of the vehicle on the track, and the guides constituting second rollers closely spaced relative to the side surfaces of the tracks and rotatable in the same direction as the movement of the vehicle on the track.

22. In a combination as set forth in claim 19, the structure being constructed to be formed from a plurality of first elements each having first and second detents and second elements each having the second detents to provide for an intercoupling of the first detents on the first elements with the second detents on the second elements.

23. In a combination as set forth in claim 22, the vehicle including a motor and rollers driven by the motor for rotation on the track, the first and second elements having side surfaces defining the width of the track, the vehicle including guides disposed relative to the side surfaces of the track for maintaining the vehicle on the track during the movement of the vehicle on the track.

24. A method of providing a controlled operation of a first toy vehicle, including the steps of:

providing an address for the first toy vehicle, providing for the first toy vehicle characteristics for movement in a selective one of two opposite directions, providing for a first intercoupling of first individual ones of first elements and first individual ones of second elements to form a first structure for holding additional toy vehicles for movement in any desired direction, providing for an intercoupling of individual ones of the first elements and individual ones of second elements to form a structure for holding the first toy vehicle for movement at each instant in a selective one of the first and second opposite directions, and providing for the transmission to each of the first toy vehicle and the additional toy vehicles of signals indicating the address of the vehicle and indicating the desired movement of the addressed vehicle and indicating the performance of functions by the vehicle other than the movement of the vehicle.

25. A method as set forth in claim 24, including the steps of, providing a key indicating an individual address, the first toy vehicle and the additional toy vehicles being constructed to receive the key and to operate in conjunction with the key to provide the individual address indicated by the received key.

26. A method as set forth in claim 24 wherein each of the first elements constitutes a beam having male and female detents and each of the second elements constitutes a block having the female detents and wherein the male detents in the first elements releasably intercouple with the female detents in the second elements.

27. A method of providing a controlled operation of a toy vehicle, including the steps of:

providing for the toy vehicle an individual address, providing for the toy vehicle characteristics for movement in a selective one of two opposite directions, providing a structure for holding the toy vehicle for movement at each instant in a selective one of the first and second opposite directions, providing a pad constructed to address the vehicle, providing for an operation of the pad to produce, for transmission, first signals addressing the vehicle and second signals providing for a movement of the addressed vehicle in accordance with the characteristics of the second signals and the characteristics provided for the addressed vehicle and third signals for providing for an operation of the vehicle other than the movement of the vehicle, and providing for the reception of the transmitted signals by the vehicle and for the movement of the addressed vehicle in accordance with the characteristics of the second signals and the characteristics provided for the addressed vehicle and providing for the operation of the vehicle, other than the movement of the vehicle, in accordance with the characteristics of the third signal.

28. A method as set forth in claim 27, including the steps of:

providing a key with ribs in an individual pattern indicating an individual address, and providing for a disposition of the key in a socket in the toy vehicle to provide for the toy vehicle an address represented by the ribs in the key.

29. A method as set forth in claim 28 wherein the vehicle is constructed to transfer play elements to and from the vehicle.

30. A method of providing a controlled operation of a toy vehicle, including the steps of:

providing an address for the first toy vehicle, providing for the toy vehicle characteristics for movement in a selective one of two opposite directions, providing a structure for holding the toy vehicle for movement at each instant in a selective one of the first and second opposite directions, providing a key indicating an individual address, the vehicle being constructed to receive the key and to operate in conjunction with the key to provide the individual address indicated by the key, and providing for a disposition of the key in the vehicle to provide for the vehicle the address indicated by the key.

31. A method as set forth in claim 30, including the step of:

forming the structure from a plurality of the beams each having male and female detents intercoupled with a plurality of the blocks each having the female detents, the structure constituting a track and the vehicle constituting a monorail movable on the track.

32. A method as set forth in claim 31, including the steps of:

providing the vehicle with rotary members movable on the track, the beams and the blocks having a pair of spaced side walls defining the width of the track, and disposing guides in closely spaced relationship to the side walls of the beams and the blocks to maintain the vehicle on the track during the movement of the vehicle on the track.

33. A method as set forth in claim 32, wherein the guides constitute rollers disposable against the side surfaces of the track and rotatable against the side surfaces of the track in accordance with the rotation of the rotary members on the track, the rollers being normally spaced from the side surfaces of the track.

34. A method as set forth in claim 32 wherein the guides constitute rollers, and wherein the additional vehicle is provided with rotary members movable on the track, and wherein the beams and the blocks have a pair of spaced side walls defining the width of the track, and wherein guides are disposed in closely spaced relationship to the side walls of the beams and the blocks to maintain the vehicle on the track during the movement of the vehicle on the track, and wherein the guides are rollers movable in the same direction as the direction of movement of the vehicle on the track.

* * * * *